US009321616B2

(12) United States Patent
May

(10) Patent No.: US 9,321,616 B2
(45) Date of Patent: Apr. 26, 2016

(54) LIFTING SYSTEMS

(71) Applicant: Marvin M. May, Los Angeles, CA (US)

(72) Inventor: Marvin M. May, Los Angeles, CA (US)

( * ) Notice: Subject to any disclaimer, the term of this patent is extended or adjusted under 35 U.S.C. 154(b) by 0 days.

(21) Appl. No.: 14/209,947

(22) Filed: Mar. 13, 2014

(65) Prior Publication Data

US 2014/0263141 A1 Sep. 18, 2014

Related U.S. Application Data

(60) Provisional application No. 61/782,259, filed on Mar. 14, 2013.

(51) Int. Cl.

| | |
|---|---|
| ***A62B 1/02*** | (2006.01) |
| ***B66C 23/62*** | (2006.01) |
| ***B66C 23/18*** | (2006.01) |
| ***B66C 23/20*** | (2006.01) |
| ***B66C 23/36*** | (2006.01) |
| ***B66C 13/08*** | (2006.01) |

(Continued)

(52) U.S. Cl.

CPC ..... *B66C 23/62* (2013.01); *B66B 9/187* (2013.01); *B66B 9/193* (2013.01); *B66C 13/08* (2013.01); *B66C 21/04* (2013.01); *B66C 23/18* (2013.01); *B66C 23/208* (2013.01); *B66C 23/36* (2013.01); *A62B 1/02* (2013.01); *A62B 1/06* (2013.01)

(58) Field of Classification Search

CPC ..... A62B 1/02; A62B 1/04; A62B 1/06; A62B 1/08; A62B 1/10; A62B 1/14; A62B 1/18; A62B 35/0081; B66B 9/187; B66B 9/00; B66C 13/08; B66D 3/043; B66D 3/02; E04G 2005/008; E04G 3/30; E04G 3/325

USPC ..... 182/142, 150

See application file for complete search history.

(56) References Cited

U.S. PATENT DOCUMENTS 249,847 A 11/1881 Macdonald
276,090 A * 4/1883 Sperry ..... 182/50

(Continued)

FOREIGN PATENT DOCUMENTS

CN 2477597 Y 2/2002
JP 2001520926 11/2001

(Continued)

OTHER PUBLICATIONS

Non-Final Office Action (dated Feb. 17, 2010), U.S. Appl. No. 12/166,946, filed Jul. 2, 2008, Inventor: Marvin M. May, (9 pages).

(Continued)

*Primary Examiner* — Daniel Cahn

(74) *Attorney, Agent, or Firm* — Blakely Sokoloff Taylor & Zafman

(57) ABSTRACT

Various lifting systems are described that use one or more of the following features. A method for setting an adjustable height upper pulley on a tall structure; load transfer from a suspended load to a tall structure; fan-based stabilizer; stabilizer or horizontal load position control mechanism using a closed loop of cable and traction winch for a crane application; crane-based lifting system that uses a closed loop of lifting cable looped around a traction winch; and a stabilizer or horizontal load position control mechanism that does not need a closed loop of cable. Other embodiments are also described and claims. Other embodiments are also described and claimed.

8 Claims, 23 Drawing Sheets

(51) Int. Cl.

| | |
|---|---|
| ***B66C 21/04*** | (2006.01) |
| ***B66B 9/187*** | (2006.01) |
| ***B66B 9/193*** | (2006.01) |
| *A62B 1/06* | (2006.01) |

(56) References Cited

U.S. PATENT DOCUMENTS

| | | | | | |
|---|---|---|---|---|---|
| 293,177 | A | | 2/1884 | Joyce | |
| 336,414 | A | | 2/1886 | Kerr | |
| 349,870 | A | | 9/1886 | Woodward | |
| 356,436 | A | * | 1/1887 | Anderson | 182/43 |
| 390,445 | A | | 10/1888 | Bruce | |
| 426,540 | A | | 4/1890 | Matthaes | |
| 440,045 | A | | 11/1890 | Lewis | |
| 481,888 | A | * | 8/1892 | Bergeron | 182/36 |
| 572,576 | A | | 12/1896 | Sjolander | |
| 640,099 | A | | 12/1899 | Cotter | |
| 734,230 | A | | 7/1903 | Hillier | |
| 845,181 | A | * | 2/1907 | Legere | 182/241 |
| 864,405 | A | * | 8/1907 | Bowen | 182/10 |
| 1,069,088 | A | | 7/1913 | Taylor | |
| 3,519,248 | A | | 7/1970 | Kushiro | |
| 3,750,686 | A | | 8/1973 | Cook | |
| 3,796,281 | A | * | 3/1974 | Dowling | 182/48 |
| 3,860,092 | A | * | 1/1975 | Holmes | 182/101 |
| 3,966,170 | A | | 6/1976 | McKenna | |
| 3,967,699 | A | * | 7/1976 | Jasch | 187/239 |
| 4,018,306 | A | | 4/1977 | Lyons | |
| 4,111,281 | A | * | 9/1978 | Jacobs | 182/10 |
| 4,209,077 | A | | 6/1980 | Yui et al. | |
| 4,318,533 | A | | 3/1982 | Port | |
| 4,355,699 | A | | 10/1982 | Smith, Jr. | |
| 4,406,351 | A | * | 9/1983 | Littlejohn et al. | 182/47 |
| 4,424,884 | A | * | 1/1984 | Smith, Jr. | 182/12 |
| 4,458,781 | A | * | 7/1984 | Ellis et al. | 182/5 |
| 4,469,198 | A | | 9/1984 | Crump | |
| 4,474,263 | A | * | 10/1984 | Christopher | 182/10 |
| 4,502,570 | A | | 3/1985 | Westerlund | |
| 4,512,438 | A | | 4/1985 | Vilchek et al. | |
| 4,538,703 | A | * | 9/1985 | Ellis et al. | 182/5 |
| 4,830,141 | A | | 5/1989 | Montaigne | |
| 4,919,228 | A | | 4/1990 | Stefan | |
| 5,090,666 | A | | 2/1992 | May | |
| 5,095,841 | A | | 3/1992 | Santos et al. | |
| 5,101,935 | A | * | 4/1992 | LaBianca | 182/236 |
| 5,253,734 | A | | 10/1993 | Laurutis | |
| 5,280,879 | A | | 1/1994 | Kreuter | |
| 5,355,975 | A | | 10/1994 | Laurutis | |
| 6,079,520 | A | | 6/2000 | Black et al. | |
| 6,089,547 | A | | 7/2000 | Juelich et al. | |
| 6,318,503 | B1 | | 11/2001 | Hernandez | |
| 6,364,063 | B1 | | 4/2002 | Aulanko et al. | |
| 6,435,595 | B1 | | 8/2002 | Chenowth | |
| 2004/0118635 | A1 | * | 6/2004 | Sun et al. | 182/142 |
| 2004/0154869 | A1 | * | 8/2004 | May | 187/239 |
| 2005/0109724 | A1 | | 5/2005 | Frumau et al. | |
| 2005/0230670 | A1 | * | 10/2005 | Kataoka | 254/335 |
| 2005/0252719 | A1 | * | 11/2005 | May | 182/48 |
| 2011/0272377 | A1 | * | 11/2011 | Willim et al. | 212/285 |
| 2014/0263142 | A1 | * | 9/2014 | Billiot et al. | 212/272 |

FOREIGN PATENT DOCUMENTS

| | | | |
|---|---|---|---|
| JP | 2003285985 | | 10/2003 |
| RU | 1836282 | A3 | 8/1993 |
| WO | WO-9921788 | | 5/1999 |

OTHER PUBLICATIONS

Non-Final Office Action (dated Apr. 3, 2006), U.S. Appl. No. 10/763,596, filed Jan. 23, 2004, First Named Inventor: Marvin M. May, (9 pages).
Final Office Action (dated Feb. 26, 2007), U.S. Appl. No. 10/763,596, filed Jan. 23, 2004, First Named Inventor: Marvin M. May, (10 pages).
Non-Final Office Action (dated Aug. 28, 2007), U.S. Appl. No. 10/763,596, filed Jan. 23, 2004, First Named Inventor: Marvin M. May, (7 pages).
Final Office Action (dated Feb. 25, 2008), U.S. Appl. No. 10/763,596, filed Jan. 23, 2004, First Named Inventor: Marvin M. May, (6 pages).
Non-Final Office Action (dated Jan. 26, 2011), U.S. Appl. No. 12/434,521, filed May 1, 2009, First Named Inventor: Marvin M. May, (11 pages).
Supplementary Partial European Search Report (dated Sep. 9, 2011), Application No. 04705344.2-1269, Date Filed—Jan. 26, 2004, Inventor: Marvin M. May, (4 pages).
Final Office Action (dated Dec. 9, 2011), U.S. Appl. No. 12/434,521, filed May 1, 2009, First Named Inventor: Marvin M. May, (12 pages).
Non-Final Office Action (dated Feb. 16, 2012), U.S. Appl. No. 12/966,846, filed Dec. 13, 2010, First Named Inventor: Marvin M. May, (19 pages).
Final Office Action (dated Jul. 3, 2012), U.S. Appl. No. 12/966,846, filed Dec. 13, 2010, First Named Inventor: Marvin M. May, (13 pages).
PCT International Search Report (dated Nov. 8, 2006), International Application No. PCT/US04/02243—International Filing Date Jan. 26, 2004, (13 pages).
Non-Final Office Action (dated Apr. 11, 2008), U.S. Appl. No. 11/185,518, filed 097/19/2005, Inventor: Marvin M. May, (5 pages).
Non-Final Office Action (dated Dec. 3, 2011), U.S. Appl. No. 12/434,521, filed May 1, 2009, First Named Inventor: Marvin M. May, (8 pages).
Non-Final Office Action (dated Aug. 14, 2013), U.S. Appl. No. 12/966,846, filed Dec. 13, 2010, First Named Inventor: Marvin M. May, (14 pages).
Non-Final Office Action (dated Oct. 4, 2013), U.S. Appl. No. 12/434,521, filed May 1, 2009, First Named Inventor: Marvin M. May, (13 pages).
"Der Hochretter Rettet sicher aus hochster Gefetn", Wahlefeld, Hochretter, Wahlefeld Stahl-Metall-Maschinenbau, Germany, (15 pages).
"TIA Standard—Standard for Installation, Alteration and Maintenance of Antenna Supporting Structures and Antennas", TIA Advancing Global Communications, TIA-1019-A, Jan. 2012, Telecommunications Industry Association, (87 pages).
Non-Final Office Action (dated Apr. 21, 2006), U.S. Appl. No. 11/185,518, filed Jul. 19, 2005, Inventor: Marvin M. May, (8 pages).
Non-Final Office Action (dated Sep. 25, 2006), U.S. Appl. No. 11/185,518, filed Jul. 19, 2005, Inventor: Marvin M. May, (6 pages).
Non-Final Office Action (dated Apr. 6, 2007), U.S. Appl. No. 11/185,518, filed Jul. 19, 2005, Inventor: Marvin M. May, (8 pages).
Final Office Action (dated Jul. 16, 2007), U.S. Appl. No. 11/185,518, filed Jul. 19, 2005, Inventor: Marvin M. May, (7 pages).
Non-Final Office Action (dated Apr. 11, 2008), U.S. Appl. No. 11/185,518, filed Jul. 19, 2005, Inventor: Marvin M. May, (5 pages).
Final Office Action (dated Nov. 18, 2008), U.S. Appl. No. 11/185,518, filed Jul. 19, 2005, Inventor: Marvin M. May, (11 pages).
"Chinese Office Action dated Jul. 18, 2008 with translation", CN Application No. 200480008305.1, (14 pages).
"Triple Barrel Tagline", Operation & Maintenance Manual, Rud • O • Matic®, Rudomatic, Inc., Los Angeles, CA, USA "Admitted Prior Art", (12 pages).

* cited by examiner

LIFTING SYSTEMS

RELATED MATTERS

This application claims the benefit of the earlier filing date of provisional application No. 61/782,259, filed Mar. 14, 2013, entitled "Lifting Systems".

BACKGROUND

An embodiment of the invention is related to lifting systems that can raise and lower personnel and equipment up to and down from an upper level of a tall structure such as a building, a cellular network communications antenna tower, a wind based electricity generator tower, or an off-shore oil/gas platform. Other embodiments are also described.

Lifting systems that can be deployed to a given job site so as to raise and lower a desired load adjacent to a tall structure have been described in U.S. Pat. Nos. 7,395,899 and 7,537,087 of Marvin M. May ("My Previous Patents") both of which are incorporated herein by reference. These systems include a closed loop lifting cable to which a load is attached and which is rotated by a traction winch to raise or lower the load. Several horizontal load position control mechanisms are also described that allow the suspended load to be moved sideways, independently from the raising and lowering capabilities.

SUMMARY

Improvements in terms of, for example, reducing the forces that are imparted to a tall structure by a lifting system (during lifting and raising), may be desirable and therefore have been developed. Some particular applications of a lifting system that uses a traction winch and a closed loop of cable or rope in the context of a crane are also described here. In a further improvement, a mechanism is described that further stabilizes a container or platform carried by the lifting system.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
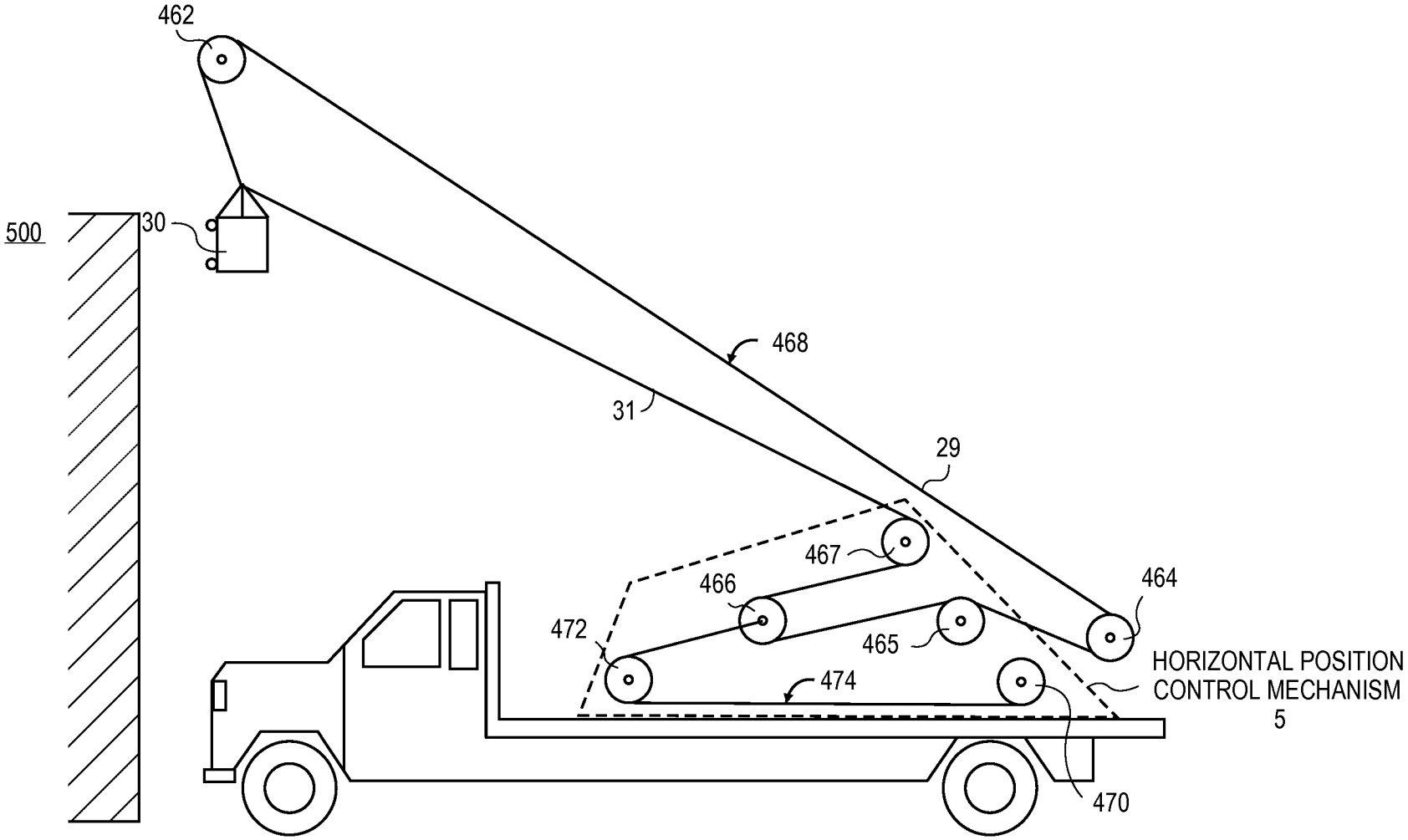
FIG. 1 is a conceptual diagram of a lifting system that uses a closed loop of cable with a horizontal position control mechanism.

FIG. 1 shows a conceptual diagram of a lifting system. A tall structure 500 is shown, which may be a building, a cellular network communications tower, a wind electricity generation tower, or an offshore oil/gas platform. A lifting system for raising and lowering a load 30 is installed nearby. Such a system may be in accordance with any one of those described in U.S. Pat. Nos. 7,395,899; 7,537,087; and 7,849,965 of Marvin May ("My Previous Patents"). The lifting system has an upper pulley 462, a traction winch or traction pulley or traction sheave 464, a closed loop of cable or rope 468, and a horizontal load position control mechanism 5. A load 30 is attached to and suspended from the cable 468 as shown (once the lifting system has been deployed). An operator of the system may lift or raise the attached load 30, by activating the traction pulley 464 so that friction between a drive pulley and the closed loop of cable 468 in essence rotates the loop in the clockwise direction to raise the load; the operator may lower the attached load 30 by activating the traction pulley 464 in an opposite direction, thereby rotating the closed loop of cable 468 in the counterclockwise direction. Note that the diagram in FIG. 1 is not to scale, and is merely being used to illustrate the concept of the system. In practice, the relative size, location, and number of pulleys used may be different than shown. For instance, fewer or additional deflector pulleys 465, 467 may be needed.

Lifting System with Horizontal Load Position Control

The lifting system shown in FIG. 1 has a horizontal load position control mechanism 5 that enables the operator to move the suspended load 30 away from the side or face of the structure 500, i.e. essentially horizontally or sideways, by activating the drum winch 470 to pull in or shorten the total length of a cable 474 that is under tension, thereby increasing tension in a tail portion 31 of the cable 468; the operator may move the suspended load towards the side of the structure 500 by activating the drum winch 470 in an opposite direction, thereby letting out or increasing the total length of the cable 474 to thereby decrease tension in the cable 468. This may also be referred to as a tail portion tension adjustment mechanism, or a stabilizer mechanism. This is achieved by a means for generating a force that moves a moveable or adjustor pulley 466, while maintaining the tail section 31 taut, so as to increase tension in the tail section 31 to thereby urge the load sideways. In one embodiment, the pulley 466 may be deemed "floating" in that it need not be held other than by tension in the tail portion 31 of the loop of cable 468. The latter has been looped around the adjustor pulley 466. The adjustment cable 474 is connected to a pivot pin of the adjustor pulley 466. In this example, the lifting system also has a set of two deflector pulleys 465 and 467. One or both of these deflector pulleys 465, 467 may be anchored to the same vehicle (as shown) as the one to which the traction pulley 464 may be secured, where such a vehicle may be a class 4 commercial truck (e.g., Ford F-450 and a GMC 4500) or trailer. Such a vehicle may be used to carry all needed equipment and personnel to a lifting job, as well as the other components described here including the upper pulley 462, the traction winch 464, the loop of cable 468, a drum winch 470, as well as the other pulleys depicted in FIG. 1.

The adjustor pulley 466 is floating or moveable, relative to other pulleys in the system. The latter may remain fixed, including traction pulley 464 and lower pulley 472. This arrangement allows tension in the closed loop of cable 468, and in particular tension in the near or tail portion 31 of the cable 468 which runs down from the suspended load 30 to the traction pulley 464, to be adjusted. Increasing this tension will impart a horizontal force that causes the suspended load 30 to move away from the structure 500, while decreasing the tension will allow gravity (or a supplied horizontal force—not shown) to move the load 30 towards the structure 500. This tension adjustment may be achieved through operation of the drum winch 470. The drum winch 470 rotates, to alternatively pull in and let out the adjustment cable 474. The latter is installed around the drum winch 470 at one end, and is connected to the adjustor pulley 466 at another end so as to pull the adjustor pulley 466. In addition, the adjustment cable 474 is installed looped around the pulley 472. Note that both the drum winch 470 and the traction winch 464 may be operated at the same time, to position the suspended container appropriately, that is both vertically and horizontally. This allows flexibility in the paths of movement of the load 30, so that the load is not constrained to a specific predetermined path. Also, the cable 468 may remain looped around the upper pulley 462 (e.g., tied to the tall structure 500 at the base), so that it can be quickly deployed when needed to for lifting a load. Another advantage is that essentially the same size or type of drum winch 470 can be used for different height structures 500.

While the adjustor pulley 466 is floating or moveable, the pulley 472 (together with the other pulleys 467, 465 and the traction winch 464 and the drum winch 470) are secured to the vehicle as shown. As an alternative, the pulley 472 could be secured to a base of the structure 500 (e.g., see FIG. 14) or to the ground nearby or to another relatively immoveable object such as a crane ladder or crane boom as in FIG. 14. Note also that while FIG. 1 shows the pulley 472 being located to the left (or front) of the traction pulley 464, an alternative here is to secure the pulley 472 to the right (or behind the traction pulley 464).

The traction pulley 464, as well as the deflector pulleys 465, 467 (if needed), along with the drum winch 470, may preferably be secured to the vehicle that arrives at the area next to the base of the structure, for instance in the event of an emergency situation or other instance where the automated lifting of the load 30 is needed. The adjuster cable 474 may be pre-reeved around the following pulley system: the lower pulley 472 (and one or more additional such pulleys to achieve mechanical gain if needed), one or more deflector pulleys 465 (as needed for clearance for example), at least one adjuster pulley 464, and the drum winch 470. In this manner, the adjuster cable 474 need not be loose and need not be dragging on the ground or closing off some of the area between the vehicle and the structure to traffic. The vehicle on which such elements are installed (note that this may also include a floating vehicle such as a boat, especially where the structure 500 is an offshore oil/gas platform) may also be used to deliver the upper or top pulley 462 to the area next to the base of the structure 500.

Figure 2:
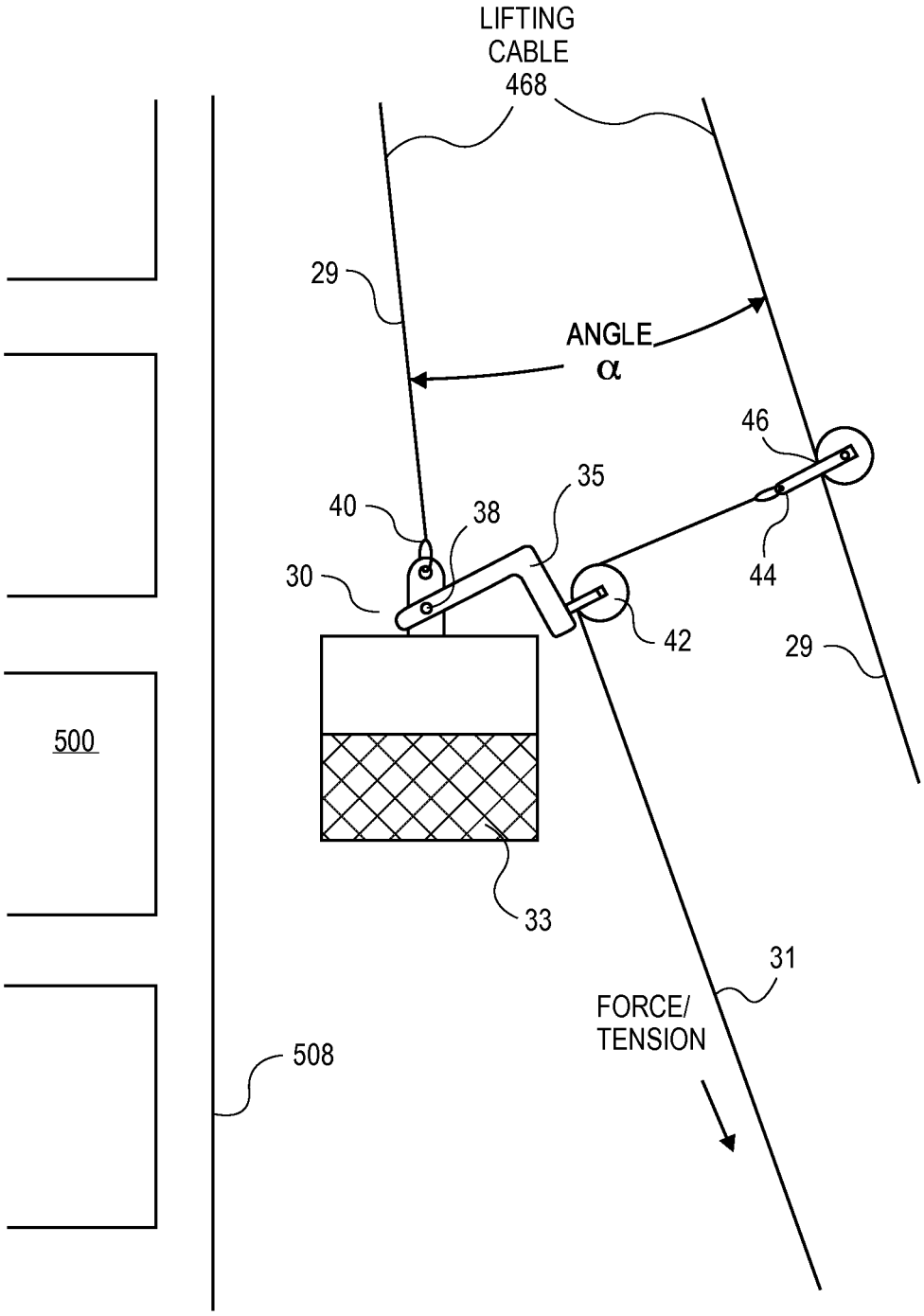
FIG. 2 shows an example of how to close a loop of the lifting system.

Referring now to FIG. 2, a close up view of an example technique for "closing" the loop of cable 468 (see FIG. 1) is shown. The cable 468 has a hoist section 29 that starts from the attached load 30 which in this example includes a container body 33 attached to a backbone 35 at a pivot 38, and continues up and around the upper pulley (not shown) and then down to the traction winch (not shown). The load 30 is thus attached to the cable between a near or tail portion 31 (also referred to as a tail line), and the far or hoist portion 29 (also referred to as the hoist line), which are on the same side of the upper pulley, that is, closer to the structure 500. The tail portion 31 may be defined as that portion of the cable 468 which starts from the traction winch down below (not shown) and continues up to the attached load 30, without passing around the upper pulley. The tail portion 31 in effect closes the loop, by being, in this case, looped around a deflector pulley 42 and then connects to a traveler pulley 46 at the end 44 of the cable 468 as shown. The traveler pulley 46 is positioned to ride in contact with and along the cable 468, and in particular along the tensioned hoist portion 29 as shown, as the attached load 30 is lowered and raised through operation of the traction winch. The hoist portion 29 thus passes through the traveler 46 on its way down to the traction winch.

Note that in this example, the deflector pulley 42 is rigidly attached to the backbone 35. An alternative here is to rigidly attach the deflector pulley 42 directly to the container body 33. The backbone 35, being pivotally attached at one end to the container body 33, helps stabilize and allows the container body to stay level. Also, to close the loop, the other end 40 of the cable 468 may be secured to the container body 33 via a snap hook (although alternative securing mechanisms are possible). Here, the backbone 35 may also allow the deflector 42 to be spaced outwards from the container 33 (if needed for clearance). Also, as an alternative, the backbone 35 may be essentially eliminated so that the deflector pulley 42 is instead directly attached to a ring or other relatively small rigid structure where the end 40 of the loop has been tied.

The above-described arrangement in FIG. 2 may reduce the force needed to pull on the tail portion 31 by the horizontal load positioning or control mechanism 5 (see FIG. 1), when seeking to move the attached load 30 away from the side or face 508 of the structure 500. As explained here above, as well as in My Previous Patents, different techniques are available for taking in the tail portion 31, thereby increasing tension in the tail portion 31 so as to move the attached load 30 away from the structure 500. The arrangement that uses an adjustable or moveable pulley 466 as seen in FIG. 1 illustrates an example of such a technique. Note that in all of these techniques, more force must be applied to (producing more tension in) the tail portion 31 in order to move the load 30 farther away from the structure 500, or in other words to achieve a smaller angle alpha (see FIG. 2). But once the angle alpha is reduced to a desired value, the tension or force may be reduced to a static level needed to maintain that angle. The static level is essentially the same for a wide range of angle alpha. To increase the angle alpha, the force/tension in the tail portion 31 is lowered below the static level until the desired alpha angle is achieved at which time the force/tension is raised back to the static level (to maintain the new alpha angle).

Figure 3:
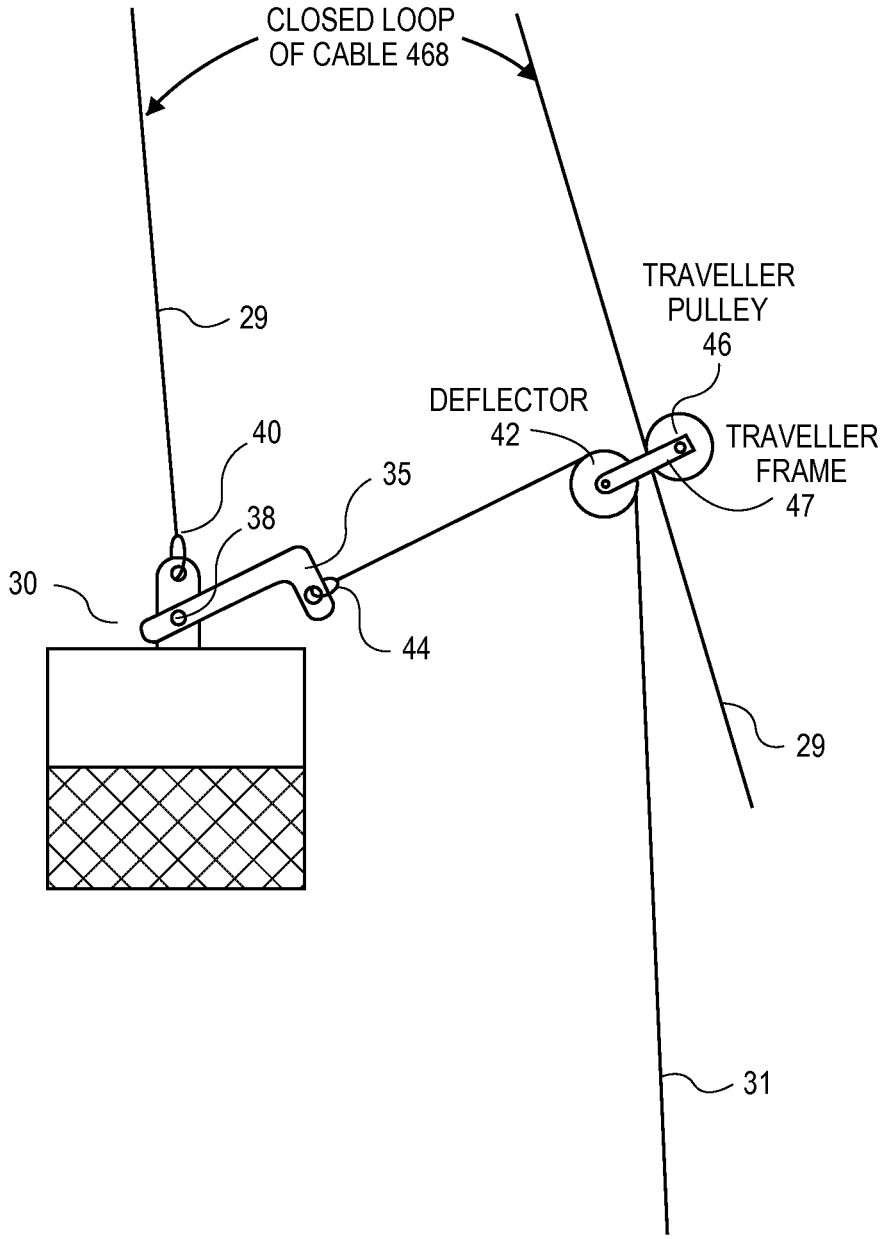
FIG. 3 shows another way to close the loop of cable.

Turning now to FIG. 3, another loop closure mechanism is shown. Here, while the loop of cable 468 still runs down on one side of the upper pulley 462 (not shown) through the traveler pulley 46, around the traction winch 464 (not shown), and then up around the horizontal position control mechanism 5 (not shown, but see FIG. 1 for example), and then around the deflector 42, the location of the deflector pulley 42 and the attachment point of the end 44 of the cable 468 are different than in FIG. 2. The traveler pulley 46 and the deflector 42 in this case are attached to the same traveler frame 47 and therefore ride as one, along the hoist portion 29 (as the load is raised and lowered by virtue of the traction winch 464 rotating the closed loop of cable 468). A particular application of the loop closure mechanism in FIG. 3 is shown in the lifting system of FIG. 4 (which is an example of the arrangement of FIG. 1). The loop closure mechanisms of FIG. 2 and FIG. 3 can also be used in other lifting system applications such as in a crane-based approach, e.g. see FIG. 11.

Adjustable Height Upper Pulley

Figure 5:
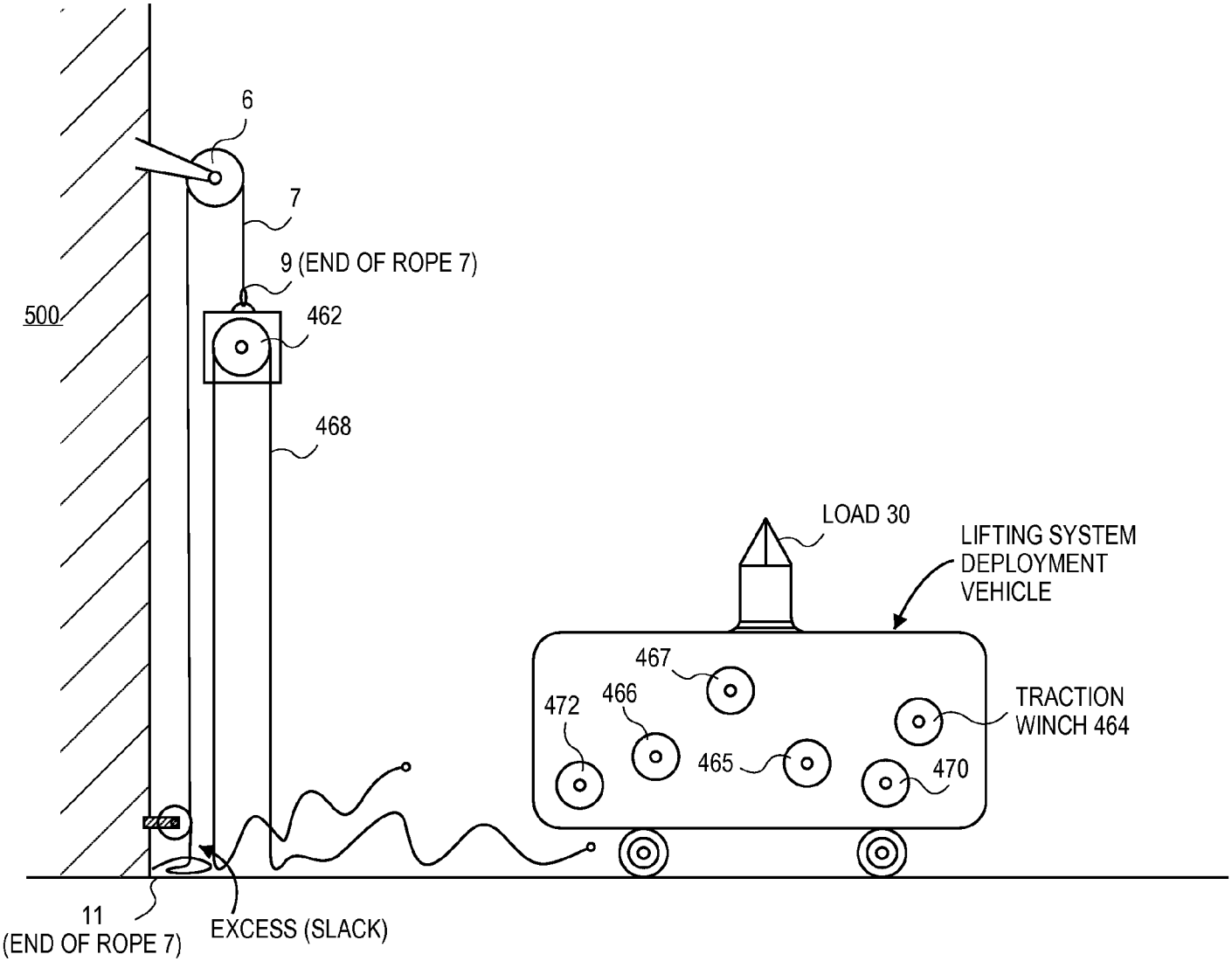
FIG. 5 is a diagram of a lifting system having an adjustable height upper pulley.

Referring to FIG. 5, a second cable or rope 7, that may (or may not) be permanently stored on the structure 500, may be used to hoist the upper pulley 462 (with the lifting cable 468 looped around it as shown) to a desired height, next to the structure 500. The pulley 462 is initially not attached to the structure 500 in this case, but rather is to be suspended from the rope 7 that is looped around a second pulley 6. The pulley 6 may be rigidly attached to the structure 500 (e.g., in a permanent way or in a temporary fashion). Since the pulley 462 will be subjected to the downward and horizontal forces generated by the lifting system during raising and lowering of the load 30, it should be set at the lowest possible height since in some instances the structure 500 may not have been designed to withstand the additional horizontal forces that are produced by the lifting system. A lower set height for the pulley 462 may lower the horizontal loads that are produced by the lifting system (upon the structure 500). The system described here may be of benefit in that it allows the pulley 462 to be set fairly easily at a variable height.

The rope 7, preferably steel wire rope (e.g., having a diameter of 5/16 inch to 3/8 inches) or other preferably weather resistant cable (for the case where the rope 7 is to remain permanently looped around the pulley 6 on the structure), is installed over or looped around the pulley 6; this installation may be permanent in that it need not be dismantled other than needed for repair or replacement of the rope 7. The rope 7 should be long enough so that both of its ends reach down to the area next to the base of the structure 500 as shown, as the rope 7 is looped around the second pulley 6. When it is time to deploy the system, an operator at the base of the structure 500 attaches the upper pulley 462 to an end 9 of one side of the rope 7. The cable 468 is now looped around the upper pulley 462. Then, the other side of the rope 7 is pulled in or downward (manually by the operator, for example) to lift the upper pulley 462 (with the cable 468 looped around it) to the desired height as shown. At that point, the operator at the base can secure the rope 7, by for instance winding it several times around a fixed drum or capstan winch as shown to generate sufficient friction to maintain the now suspended upper pulley 462. Alternatively, the rope 7 may already be wound around a powered drum winch that has a brake feature, which brake feature is activated when the pulley 462 has reached the desired height.

Figure 4:
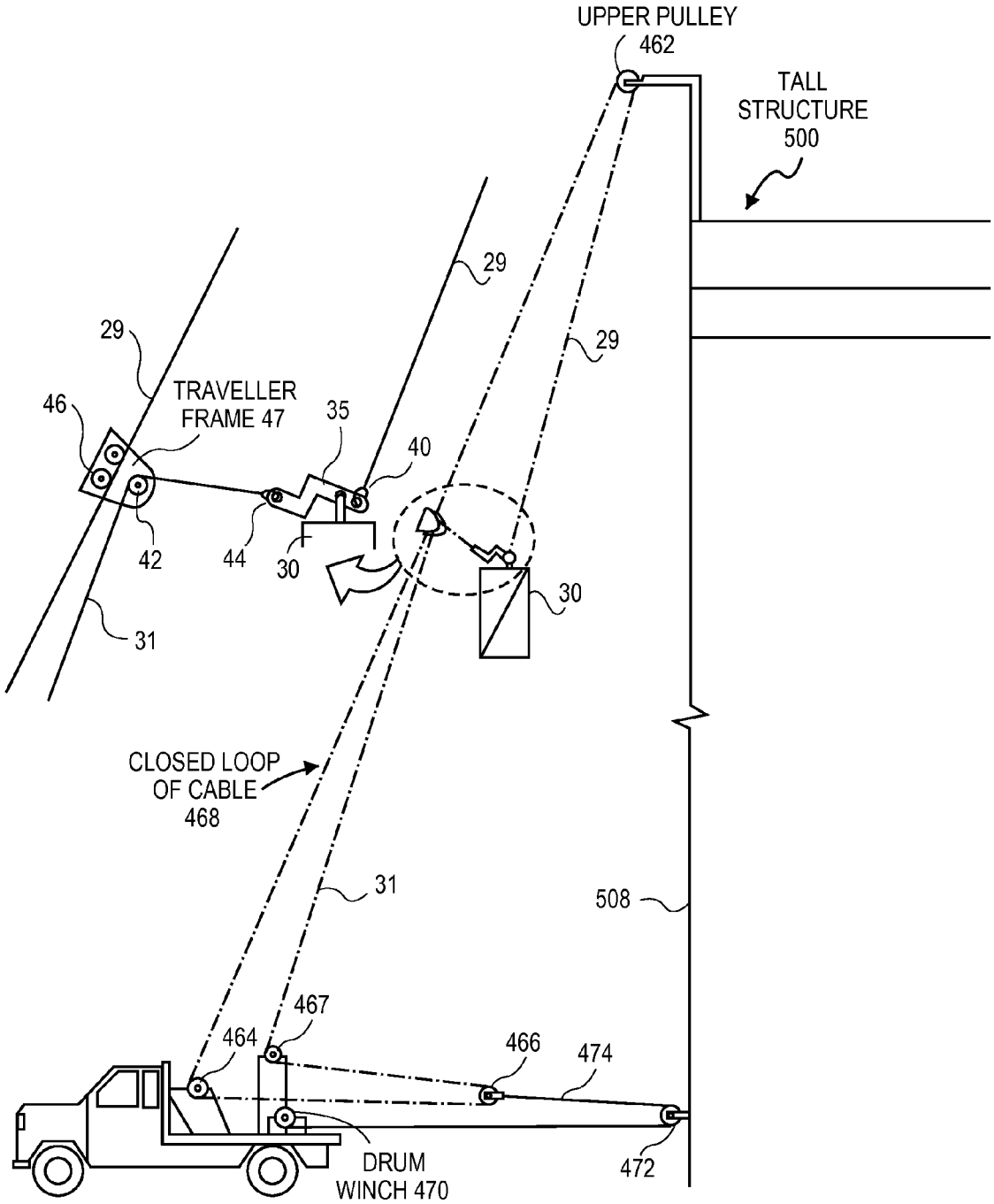
FIG. 4 illustrates a lifting system using the loop closure mechanism of FIG. 3.

Once the pulley 462 has been raised to the desired height as shown, a worker at the base of the structure 500 (not shown) can install or loop the cable 468 around the pulleys 464-470 of the lifting system, the loop of cable 468 is closed (e.g. as in FIG. 2 or as in FIG. 3), the cable 468 is placed under tension (e.g., by setting the position of the moveable/adjustable pulley 464, using for instance the approach depicted in FIG. 4 in which the drum winch 470 is activated to take in the rope 474), the load 30 is attached to the cable 468, and the lifting operations can then begin and proceed (for example in the manner described in My Previous Patents). Thus, the upper pulley 462 can be deployed in this manner, together with the cable 468 and the traction winch 464, each time there is a need to lift a load to an upper level of the tall structure 500.

Once the lifting and lowering operations have been completed, the above operations can be reversed by lowering the load 30 and removing it from the cable 468, de-tensioning the loop of cable 468 and then removing it from the pulleys 464-470, and then lowering the pulley 462 back down to the base by letting out the rope 7. The rope 7 can then be tied or otherwise secured at the base area next to the structure (while looped around the pulley 6) to remain in that state until the next lifting job at the site. The upper pulley 462 together with the cable 468 and the traction winch 464, may be taken away from the tall structure 500 and stored in a warehouse or other area that is protected the weather and from unauthorized persons.

As an alternative to having the pulley 6 and/or the rope 7 permanently installed in their position on the structure 500, a worker can climb the structure 500 from the base (or alternatively be raised) while carrying the pulley 6 and/or the rope 7 (optionally looped around the pulley 6), to a desired height where the pulley 6 is hung (or otherwise securely attached to) a support member of the structure 500. The worker can also at that point loop the rope 7 around the pulley 6, allowing the ends of the rope 7 to reach down to the base where the pulley 462 may be attached to the end 9 of the rope 7 (and then hoisted up as shown in FIG. 5). Once the lifting job has been completed, the above process can be reversed by the worker climbing or being raised back up the structure, to detach and then carry down with him the pulley 6 and/or the rope 7.

Also, while the rope 7 and pulley 6 are shown as being located outside the structure 500, they could alternatively be located inwards of the periphery of the structure 500 within a hollow column, e.g. as in a cellular phone tower or electrical power transmission tower.

Transferring a Suspended Load from a Cable onto a Tall Structure (and Vice Versa)

Figure 6:
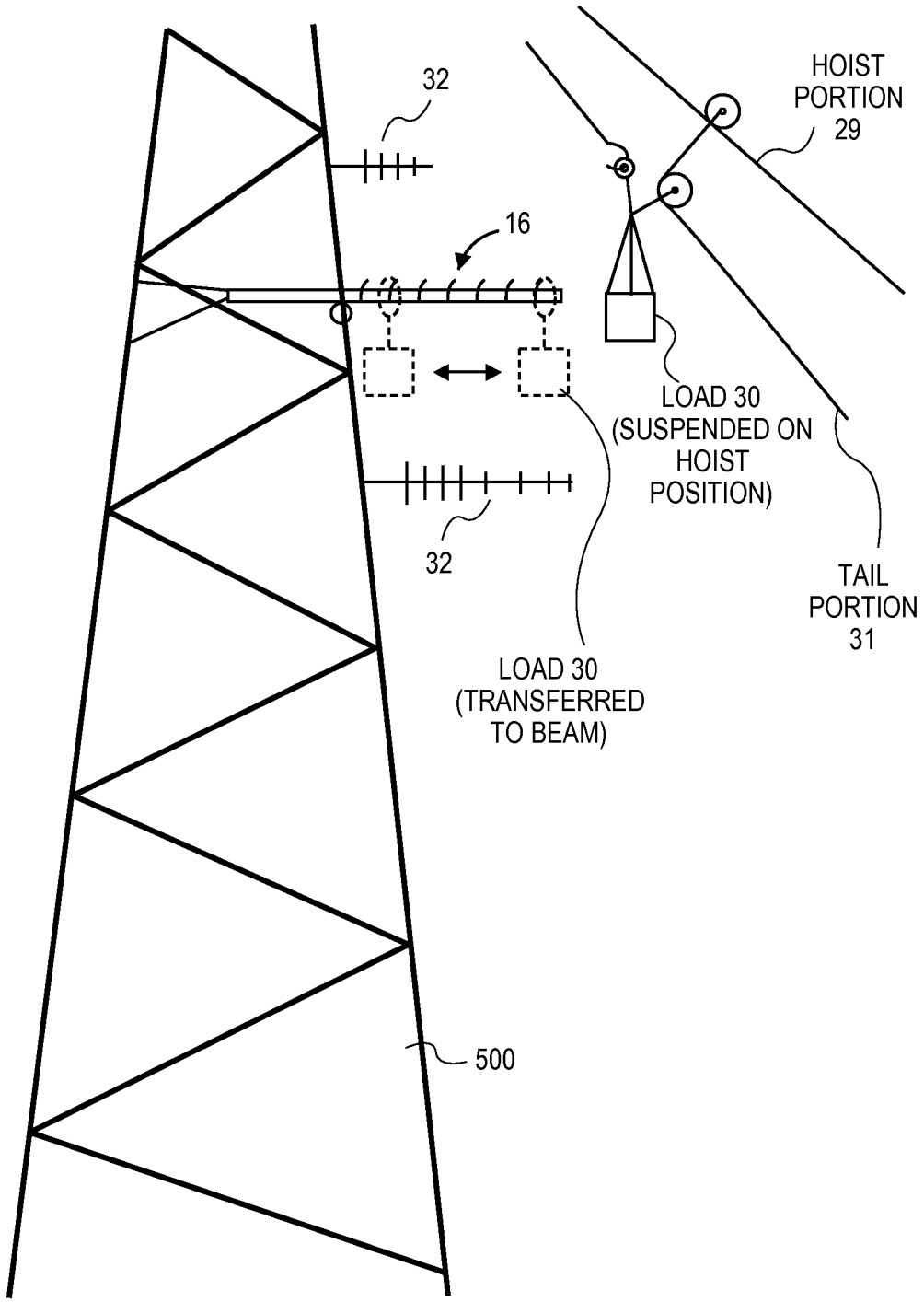
FIG. 6 shows a telescopic pipe or other beam type of mechanism attached to a tall structure, being used for easier unloading from a lifting system.

Referring now to FIG. 6, a further embodiment of the invention is shown that may make it easier to transfer a suspended load 30 from a hoisting line to an upper level of the tall structure 500. In this case, a telescopic pipe or other extendable and retractable beam mechanism 16 that juts outward, i.e. substantially horizontally, from the tall structure 500, may be attached to the tall structure 500. Alternatively, the beam mechanism 16 need not be extendable/retractable, and can simply use a fixed length beam that is secured in a substantially horizontal position or orientation as shown; in addition, the beam itself may be temporary or removable in that it would need to be initially installed into its deployed horizontal position as shown, and then after the lifting job is complete could be removed by a worker. Preferably, when deployed into its state as shown (e.g., fully extended state), the far end of the beam is located, in a horizontal direction, beyond the edges of any items that protrude from the side or face of the structure 500 as shown, e.g. cellular network antennas 32. The load 30 is then transferred from the hoisting line onto the extended beam. The beam mechanism 16 may have a chain, or other flexible line with projections, that secure the load 30 to its beam. The flexible chain may then be operated, as shown, to pull the load 30 towards the tall structure along the beam.

In another embodiment, the suspended load 30 is detached from the hoist line and then placed into a load carrier (e.g., a basket) that is secured to the chain of the beam mechanism 16. The load carrier can be moved out along the beam and then picked up by a worker and attached to the hoisting line as part of the load 30 (to then be lowered to the ground or a lower base area of the tall structure 500). Alternatively, the load carrier may be left to remain on the upper level of the tall structure.

Stabilizing a Suspended Load Using a Fan

Figure 7:
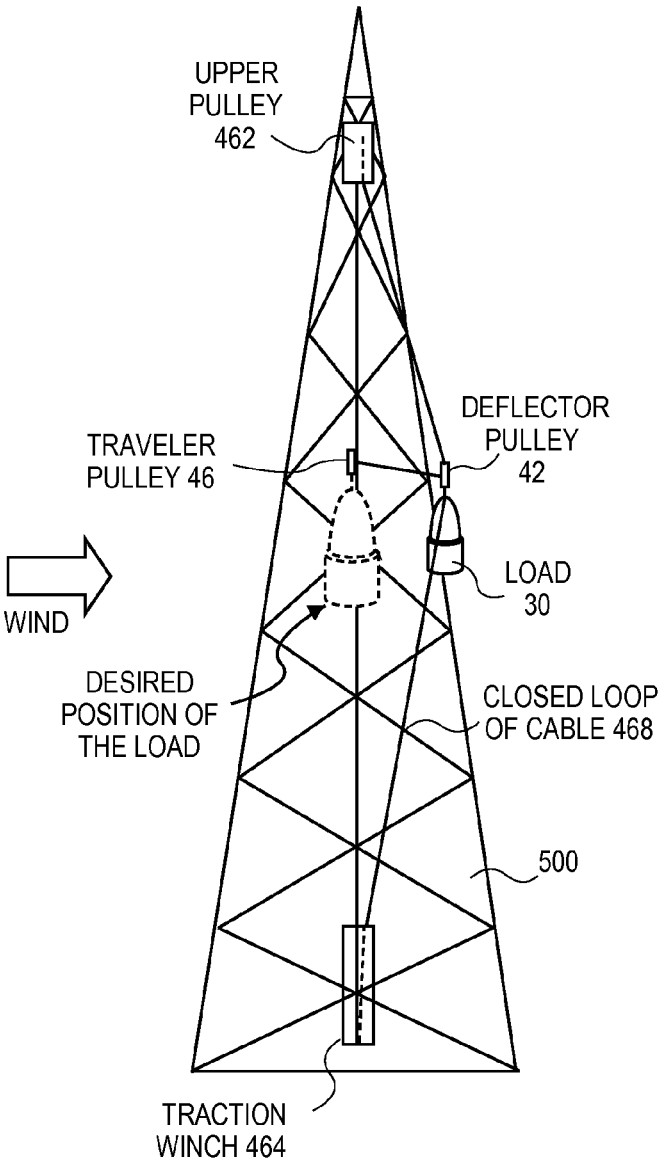
FIG. 7 is a side view of a tall structure showing a suspended load being pushed sideways by wind.
Figure 8:
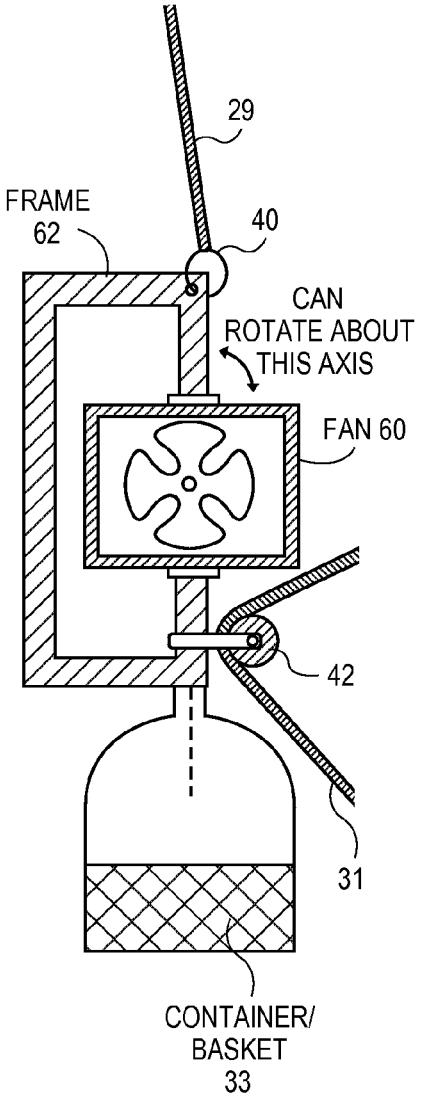
FIG. 8 illustrates a fan-based stabilizer that is mounted to a suspended load.

Turning now to FIG. 7 and FIG. 8, another embodiment of the invention is depicted that enables stabilization of a suspended load 30, for instance in the case where there is a strong wind blowing. FIG. 7 shows a side view of the tall structure 500 with a lifting system as described in My Previous Patents being deployed, except that the horizontal load position control system 5 (e.g., see FIG. 1) is not shown. FIG. 7 also shows the suspended load 30 being pushed sideways by the wind. Note how the desired position of the load 30 is indicated, which should be aligned with the upper pulley 462 and the traction winch 464 below. In accordance with an embodiment of the invention shown in FIG. 8, a fan 60 has been added that in the example shown can rotate about a vertical axis, as attached to a frame 62. The end 40 of the hoist portion 29 of the cable 468 is attached to the frame 62, above the fan 60 as shown. Also attached to the frame 62, but in this example below the fan 60, is the deflector pulley 42 (see FIG. 2). A load, e.g. a container/basket 33, may be attached to the frame 62, e.g. below the fan 60. Note that load 30, here the container 33, may be rigidly attached to the frame 62 so that the two may move together.

An operator of such a lifting system can enable an automatic control system (not shown) that detects the position, orientation, and/or movement (POM) of the container 33 (e.g., using a POM sensor means that may include an accelerometer, a gyroscope, a laser, radar, and/or a global positioning system). A further input to such a control system may be from an air velocity meter or anemometer. In one embodiment, the load 30 should remain centered on an imaginary line between the traveler pulley 46 on the load line and the point on the structure 500 that has been chosen to land the load 30. When the load 30 drifts off of this imaginary line, the fan 60 should pull it back onto the line. While knowledge of how far the load 30 is from its intended landing point may help compute the fan direction and speed, it may also help if the control system can simply compute the direction that the load 30 is offset relative to the imaginary line, which will then be used to property orient the fan to put the load 30 back onto the chosen line. The control system then computes the desired orientation or direction of the fan 60 (because the fan is rotatable about the vertical axis) and the speed of the fan 60, and commands the fan 60 to such a setting in order to cancel the effect of the wind on the suspended load. This should allow the suspended load 30 to move back to its desired, vertically aligned orientation (see FIG. 7). In another aspect, a wind measurement is made using the anemometer, including wind speed and/or wind direction, and this information is then used by the system to automatically adjust the attitude or direction of the fan and its speed.

It should be noted that fans have been used before for building maintenance, where they have been used to force a hanging load against the building facade to create enough friction to keep the load from swaying and being blown around by wind. However, in accordance with an embodiment of the invention here, a purpose of the fan is to stabilize a hanging load (similar to clothes that are hanging on a clothes line and are being blown around by wind) between two opposing forces. One force is from the traveler pulley 46 (see FIG. 7) and the horizontal load position control mechanism 5 (see FIG. 1); the opposing force is produced by the fan propeller. By appropriately adjusting these two forces (using the electronic control system), the hanging load can be stabilized as well as being positioned inwards or outwards (towards and away from the face of the structure 500). Using feedback from the POM sensor means, the control system orients and controls the speed of the fan to thereby allow the hanging load to be accurately positioned and also to maintain that position essentially constant, i.e. aligned with the upper pulley 462 and the traction winch 464 one the one hand and horizontally spaced from the face of the structure 500 on the other, even while the load is being raised or lowered. This stabilization mechanism may also lessen the risk that the load will sway so much that it will contact and therefore possibly damage any objects that are installed on the structure 500 (e.g., antennas) or portions of the structure 500 itself.

Stabilizing a Load that is Suspended from a Crane

Figure 9:
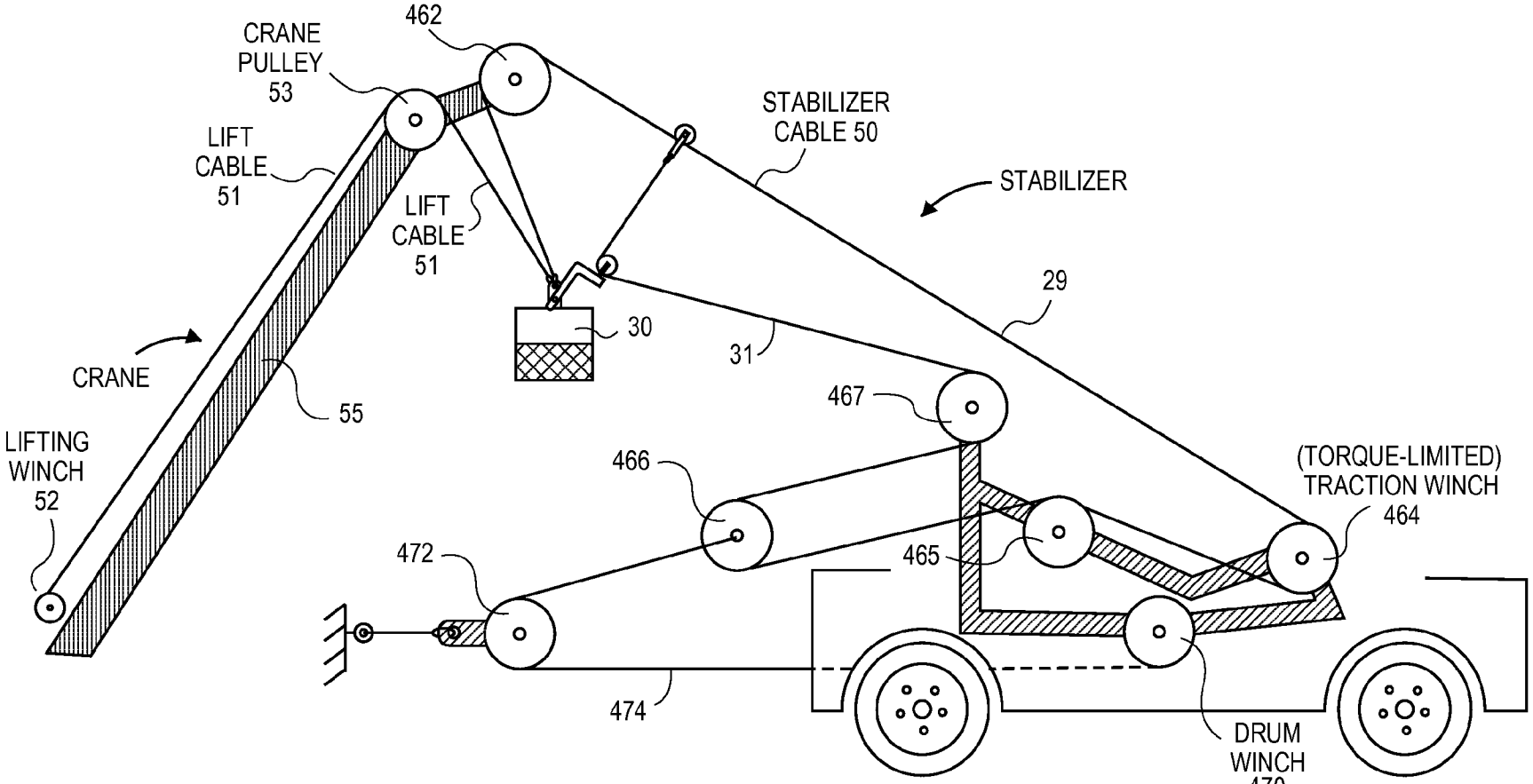
FIG. 9 shows ground-based load stabilizer or horizontal load position control mechanism being used in conjunction with a crane from which a load is suspended.
Figure 10:
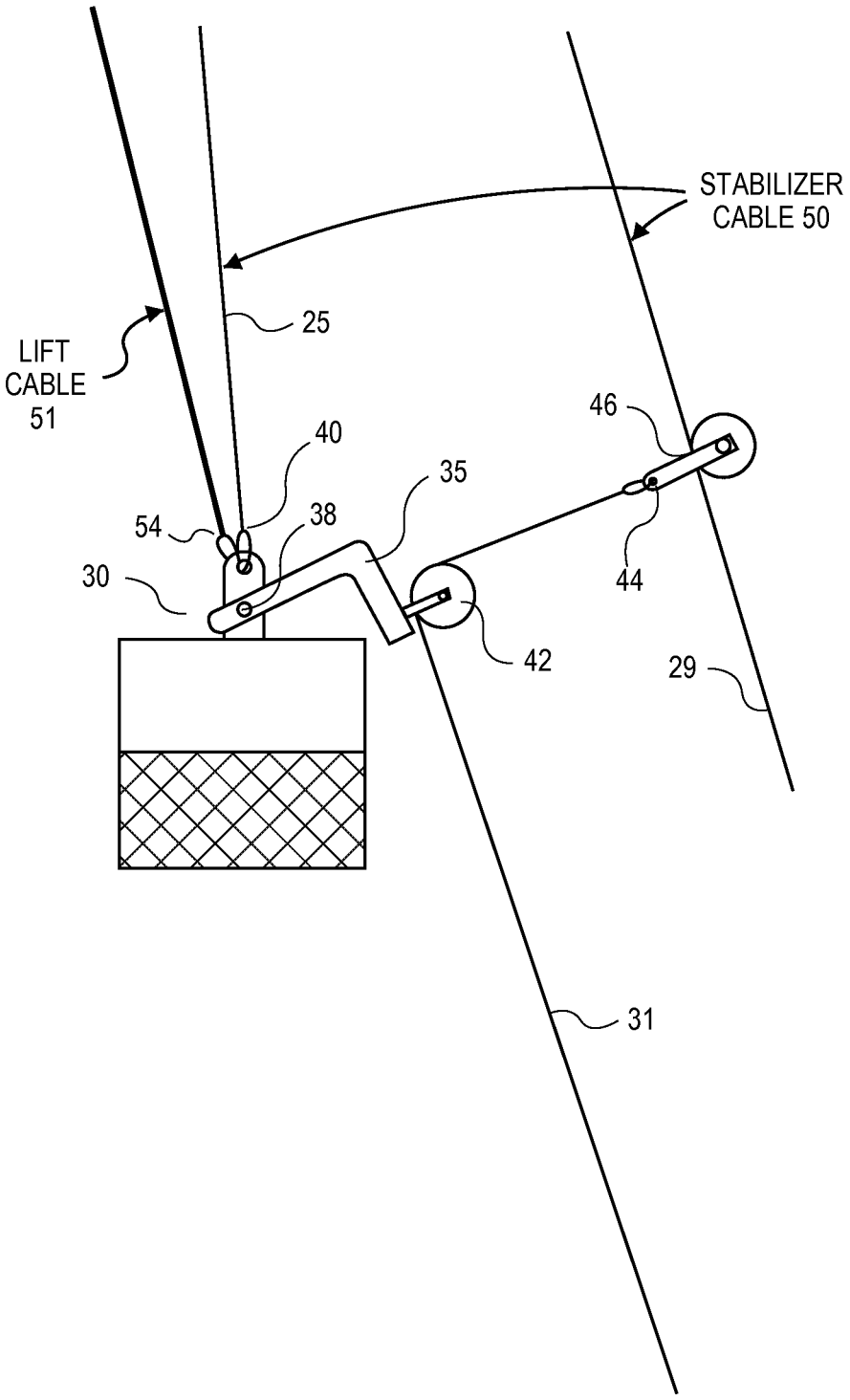
FIG. 10 shows an example technique for closing the loop of the stabilizer mechanism of FIG. 8.

Referring now to FIG. 9 and FIG. 10, these diagrams show how a load 30 that is suspended from a crane boom 55 can be stabilized in a side to side direction (e.g., in the case of strong wind, a sudden weight shift in the load 30, and/or a sudden movement of the crane boom 55). Referring to FIG. 9, in a way that can be entirely conventional, the load 30 is tied to a lift cable 51, which is installed around a crane pulley 53, the latter being fixed to the crane boom 55. The lift cable 51 then extends down to and is wrapped around a lifting winch 52 which may be a drum winch. The crane should be able to fully support the weight of the load 30, via sufficient tension in the lift cable 51 and sufficient torque generated by the lifting winch 52.

In accordance with an embodiment of the invention, the conventional crane system shown in FIG. 9 can be modified through the addition of a stabilizer as shown, whose constituent components include many of the elements of the lifting system shown in FIG. 1. The lifting system of FIG. 1 is thus modified for use as a stabilizer, to stabilize the load 30 that is suspended by a conventional crane. This is achieved by attaching the load 30 to what is now referred to as a stabilizer cable 50 which may be the closed loop of cable 468 of FIG. 1. The stabilizer cable 50 can also be "closed" in the manner shown in FIG. 10, which may be the same as in FIG. 2. Alternatively, the loop of the stabilizer cable 50 of FIG. 9 may be closed in the manner shown in FIG. 3. The traction winch 464 is now a torque-limited, constant torque device that may be configured to supply a constant torque to place the stabilizer cable 50 under tension, in order to prevent the load 30 from swinging in a substantially horizontal direction. The traction winch 464 is torque limited because it should not be able to lift or raise the load 30; lifting of the load 30 should only be performed by the lifting winch 52.

It should be noted that FIG. 10 shows the stabilization effect on the load 30 in somewhat exaggerated fashion, where the angle of the lift cable 51 relative to the vertical is exaggerated. In practice, that angle may be much smaller, in accordance with the amount of sideways (horizontal) force produced by the stabilizer in order to stabilize the load 30.

To help in further stabilizing the load 30 that is suspended from the crane boom 55, a fan mechanism such as the one described above in connection with FIG. 8 may be added to the arrangement in FIG. 9. In particular, the arrangement in FIG. 9 where the load 30 is hanging from both the lift cable 51 and the portion 29 of the stabilizer cable 50 may be modified, by attaching the lift cable 51 and the portion 29 to a frame 62 (on which a fan 60 has been installed as in FIG. 8).

Lifting System Add-On to an Aerial Ladder or Aerial Work Platform

Figure 11:
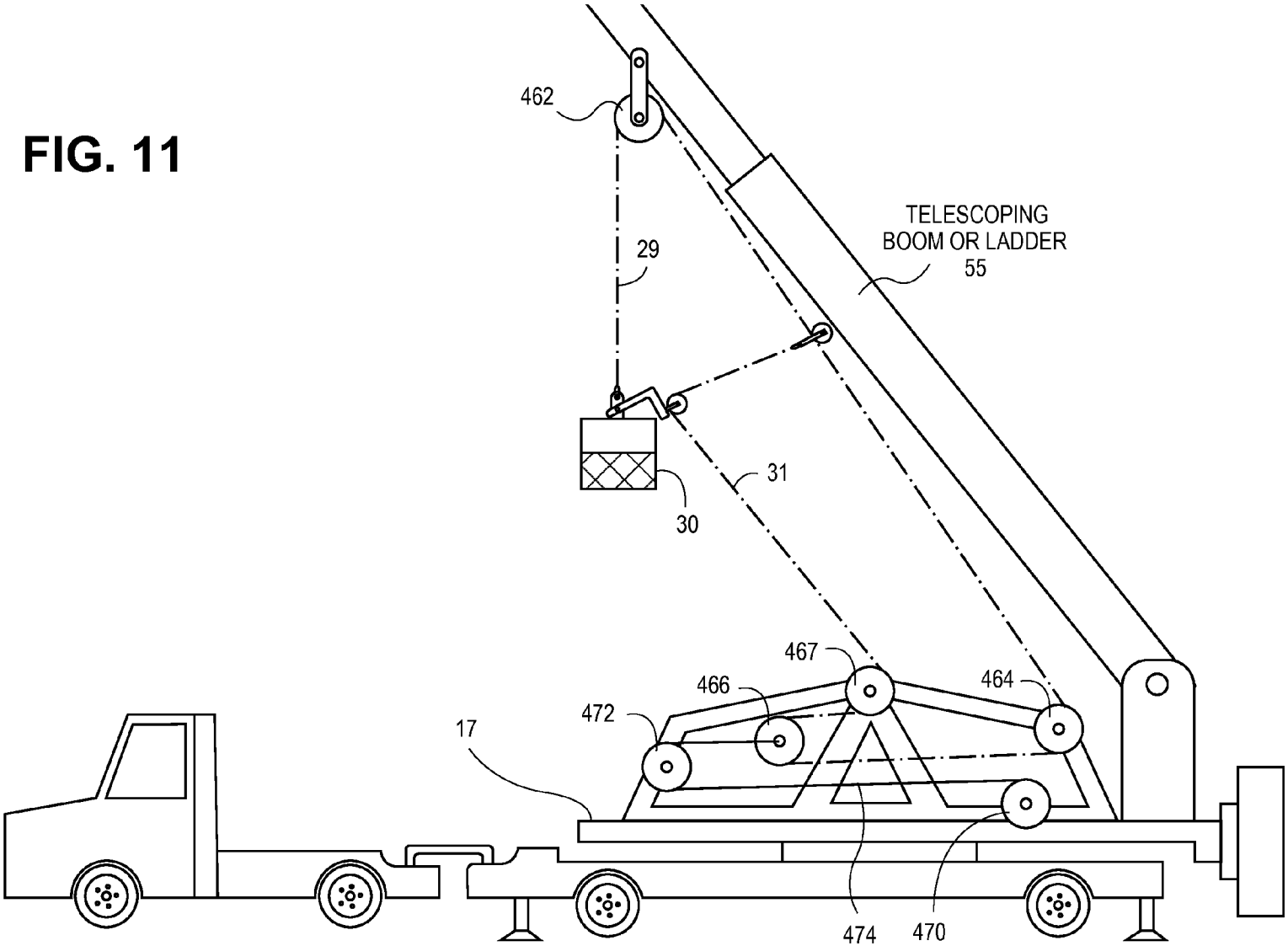
FIG. 11 depicts a crane-based lifting system that uses a closed loop of cable for lifting and a horizontal load position control mechanism mounted on a turn-table.
Figure 12:
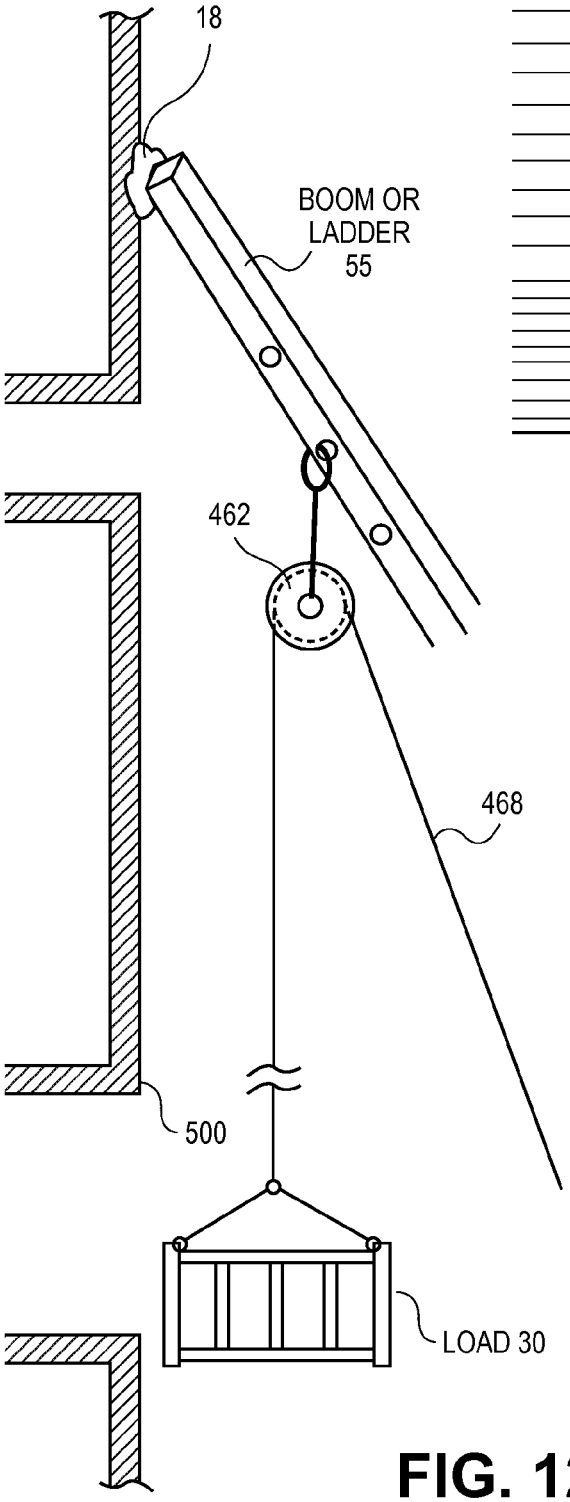
FIG. 12 shows a crane-based lifting system in which the crane boom or ladder is resting against a side or face of a tall structure.
Figure 13:
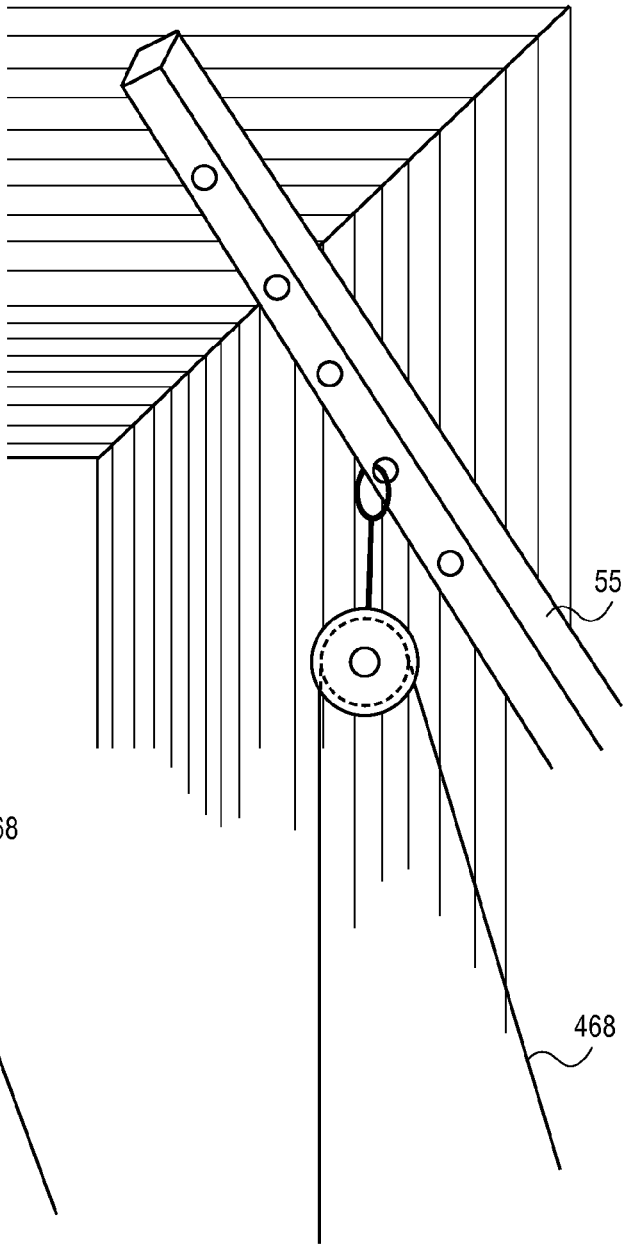
FIG. 13 depicts a crane-based lifting system whose boom is resting against a top corner of the tall structure.

Referring now to FIG. 11, a lifting system similar to that of FIG. 1 is shown that may be an add-on or accessory to an otherwise conventional aerial ladder or aerial work platform (referred to here for convenience as simply an "aerial"). In this example, the aerial comprises an articulated, wheeled vehicle having a towing engine or tractor that is coupled to a trailer as shown (e.g., a fire department tractor trailer combination). Note that as an alternative, the lifting system could be installed on the bed of a smaller vehicle that is not articulated, such as a class 6 or class 7 commercial truck (e.g., International Durastar, GMC Topkick), or even a watercraft floating crane vehicle such as a crane ship. The aerial has a telescoping boom or ladder 55 installed in this case at the far end portion of the vehicle as shown. The upper pulley 462 of the lifting system may be attached as far as needed on the boom/ladder 55, in view of the expected maximum weight of the load 30 and the load rating of the aerial itself. Note, however, that as shown in the drawing, the upper pulley 462 is offset from the top end or tip of the boom 55 (not shown)—this allows the top end to rest against a nearby tall structure 500 if needed, as shown for example in FIG. 12. Typically, aerials have a low working load capability at their tip, especially when the boom 55 is oriented well off the vertical. In that case, to increase the working load capability, the tip could rest against a building (preferably away from the windows) or other tall structure, to an upper level of which a load needs to be raised by the lifting system—see FIG. 12. Alternatively, the boom 55 (if it is long or tall enough) could extend over the roof or top of the tall structure, so that an intermediate section (between the tip and the attachment point of the upper pulley 462) would rest against a corner or edge of the tall structure—see FIG. 13, e.g. directly above the windows in the case of a building. In either instance, a pillow or cushion 18 may be provided between a load-bearing surface of the structure 500 and the boom 55 so as to spread the load created by the lifting system (and in particular the boom 55) leaning against the structure 500.

The lower pulleys of the lifting system in FIG. 11 may be installed on a bed of the vehicle; in this particular case, those pulleys are affixed to a turn-table 17, to which the boom/ladder 55 is also affixed at a far end portion of the vehicle. A near end portion of the vehicle in this case includes a tractor, forming a tractor-trailer combination. The lifting system pulley components are similar to those of FIG. 1, and they include the traction winch 464, the "routing" or deflector pulley 467, and the moveable adjuster pulley 466 around all of which the closed loop of cable 468 has been looped or installed. In this case, absent from the horizontal position control mechanism 5 (see FIG. 1) is the further routing or defector pulley 465; that may be because the cable 468 has sufficient clearance relative to the drum winch 470 (around which the adjustment cable 474 is wound), so that the further routing pulley 465 is not needed. As to the pulley 472, it has also been secured to the vehicle; in this particular case, the pulley 472 is secured to a front-end portion of the turn-table 17, however as an alternative it could be secured elsewhere on the vehicle, so long as there is sufficient clearance for the adjuster pulley 466 to move so as to raise and lower the tension in the tail portion 31 of the cable 468 using the drum winch 470 (in order to move the suspended load 30 substantially horizontally or sideways). See, for example, FIG. 14 described below in which the pulley 472 is attached to the boom 55. As a further alternative, the pulley 472 could be secured to the tall structure 500 (see FIG. 4), to the ground, or to another suitably strong and immobile structure nearby (see FIG. 9).

In the manner shown in FIG. 11 and described above, incorporating the lifting system of FIG. 1 into the aerial vehicle could essentially turn a conventional aerial into a high capacity crane. While the load bearing capacity of the conventional aerial is much greater when its boom/ladder 55 is oriented essentially vertical, it cannot easily be used in that orientation to reach an upper level of a nearby tall structure because it cannot be positioned close enough to the structure. By adding the lifting system as shown in FIG. 11 and described above in connection with FIG. 12 in which the pulley 462 is offset further along the boom 55 away from the tip, the transformed aerial could support a cage (as part of the load 30) that could swing and/or is wide enough to reach the side or face of the tall structure 500, despite the boom 55 being orientated substantially less steeply than vertical. The boom or ladder 55 may be resting against the very top of a nearby tall structure 55, at a point along the boom 55 that is above where the upper pulley 462 is attached, so the load 30 could land fairly close to the side or face of the tall structure (either at the bottom near the base or at some upper level)—see FIG. 13. That may be the preferred approach, if the boom/ladder 55 is tall enough. If the boom/ladder 55 is not tall enough, then the upper pulley 462 may be attached to the ladder 55 at or very near the tip of the ladder, with the tip also resting against the tall structure 500 (e.g., above the windows or other opening in the tall structure below it, next to which the load 30 is to be landed). Alternatively, the upper pulley 462 may be attached farther down the ladder from its tip, in which case a wider cage (load 30) that is wide enough to reach the windows or other opening on the face of the tall structure may be used—see FIG. 12.

In the above-described arrangement of FIG. 11, essentially all of the lifting system components can be pre-installed on the vehicle as shown, prior to the vehicle arriving at the job site (including the cable 468 installed around the upper pulley 462). The lifting job may therefore be completed in a shorter time as the lifting system arrives to the job site pre-assembled.

Figure 14:
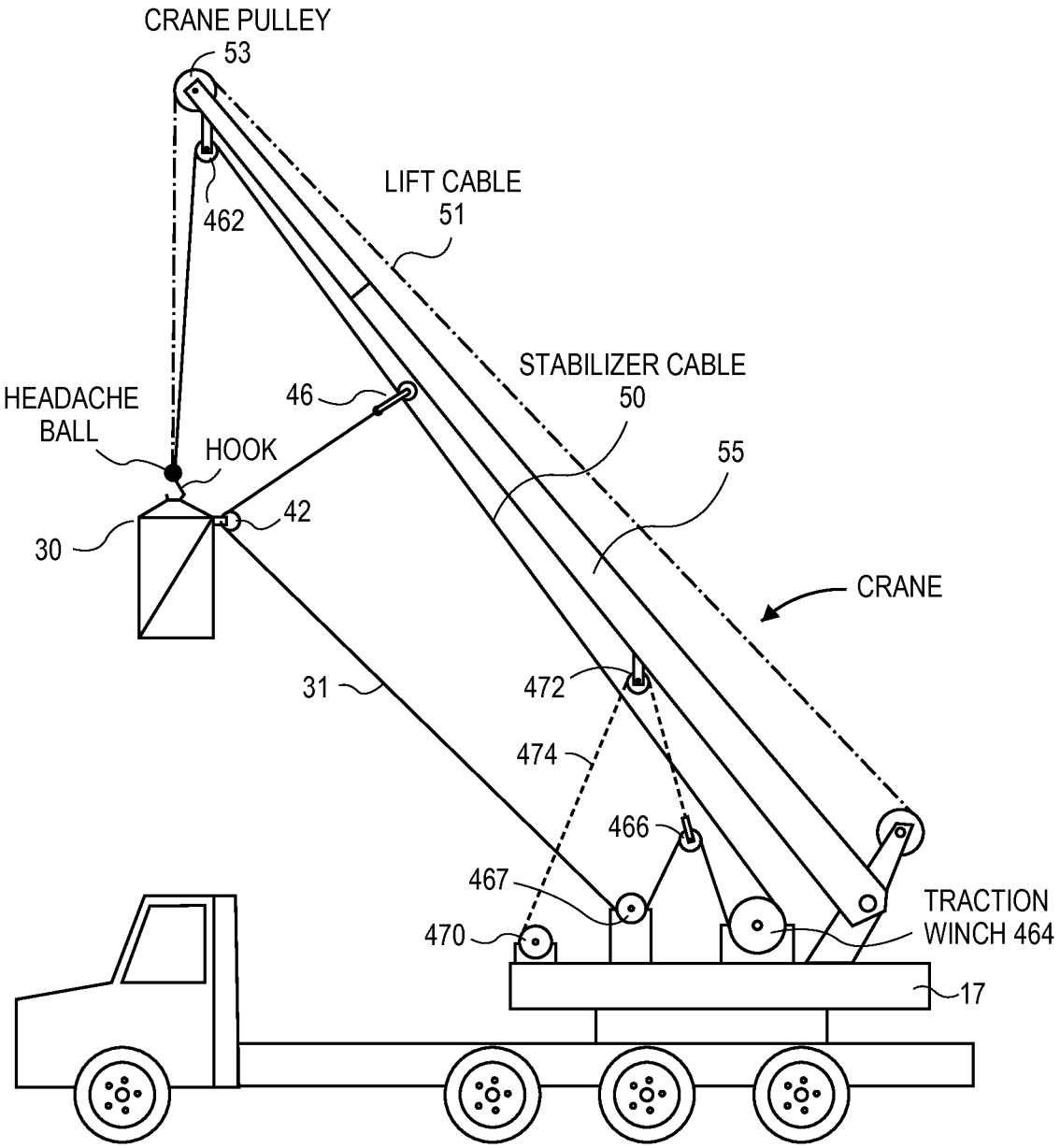
FIG. 14 shows a crane-based lifting system with a load stabilizer or load position control mechanism mounted on a turn-table.

Referring now to FIG. 14, a vehicle is shown on which a crane is installed that can lift a load 30 by suspending the load from a crane boom 55. A mechanism is also illustrated that can stabilize the suspended load 30 in a side-to-side direction (e.g., in the case of a strong wind, a sudden weight shift in the load 30, a sudden movement of the crane boom 55, or other force). In a way that may be entirely conventional, the load 30 is tied to a lift cable 51 which is installed or looped around a crane pulley 53, the latter being fixed to the crane boom 55. The lift cable 51 extends down to and is wrapped around a lifting winch 52 which may be a drum winch. The crane should be able to fully support the weight of the load 30, via sufficient tension in the lift cable 51 and sufficient torque generated by the lifting winch 52. Here it should be noted that, in contrast to the embodiment of FIG. 9, the lifting winch 52 is installed on the same vehicle as a stabilizer mechanism that includes a torque limited traction winch 464, as well as other components similar to those described in the embodiment of FIG. 9. In particular, the lifting winch 52, the traction winch 464, the deflector pulley 467, and the auxiliary drum winch 470 are all installed on a turn-table 17, on the bed of a truck or trailer or other wheeled commercial vehicle. Note that as an alternative, the turn-table may be installed on a watercraft floating vehicle, such as a barge.

The components of the stabilizer depicted in FIG. 14 are similar to those depicted in FIG. 9, and may be viewed as a modified version of the lifting system of FIG. 1. The stabilizer in FIG. 14 is similar to that of FIG. 9 described above, except in at least the following aspects. The fixed pulley 472 around which the adjustment cable 474 is reeved is now secured to the crane boom 55. As before, the adjustment cable 474 is attached at one end to a moveable pulley 466 around which the tail section 31 of the stabilizer cable 50 is looped, whereas another end of the adjustment cable 474 is wrapped around the auxiliary drum winch 470. Note also that the stabilizer cable 50, in this embodiment, may be a closed loop in the same manner as described above in connection with FIG. 10, by tying an end 44 of the tail section 31 to a traveler pulley 46, while an end 40 of the hoist or load section 29 is tied to the container 33 or load 30.

Figure 15:
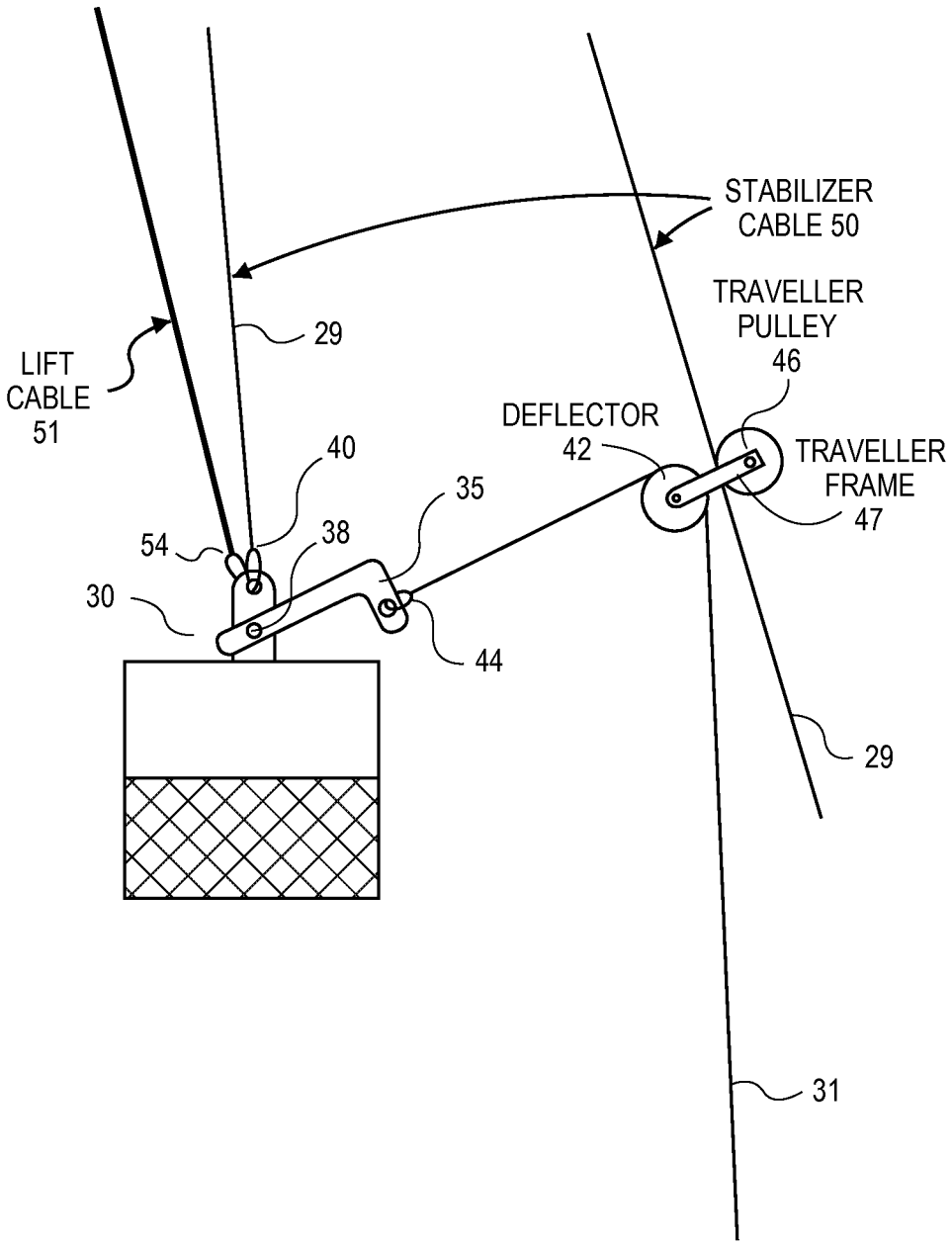
FIG. 15 shows the loop closure technique of FIG. 3 applied to a stabilizer mechanism.

An alternative to the loop closure mechanism in FIG. 14 is the approach depicted in FIG. 15. FIG. 15 is a close-up view of an example technique for closing the loop of a stabilizer cable 50 (as used in the embodiment of FIG. 14 for instance). In contrast to the embodiment of FIG. 10, the loop closure mechanism in FIG. 15 has the tail section 31 tied at its end 44 to the load 30 (either directly, or in this case indirectly via the backbone 35) rather than to the frame of the traveler pulley 46. Further, the deflector 42 has been moved from the backbone 35 to a traveler frame 47 (such that both the traveler pulley 46 and the deflector pulley 42 are attached to the traveler frame 47 as shown and move as one along the load section 29, as the load is raised and lowered). As such, this closure mechanism is similar to the one depicted in FIG. 3 for closing the lifting cable 468. The tail section 31 is looped or reeved in the same way as in FIG. 10, namely by being reeved around the deflector 42 before being attached at its end 44. With such an arrangement, the tail section 31 remains closer to the load section 29 during operation, thereby allowing additional clearance below the suspended load 30 during operation of the stabilizer, for the tail section 31. This can be seen by comparing FIG. 10 and FIG. 15, where in FIG. 15 there is additional clearance between the right side of the load 30 and the tail section 31.

Operation of the stabilizer of FIG. 14 may require that there be a minimum amount of tension in the load section 29 of the stabilizer cable 50 (which runs from the hook, up around the pulley 462 and down to the traction winch 464), sufficient to allow the traveler 46 to use the cable 50 to provide stabilization for the load 30, and to also move the load 30 in a horizontal direction. As with the stabilizer of FIG. 9, activation of the drum winch 470, so as to take in the adjustment cable 474, will result in the moveable pulley 466 being pulled to thereby increase tension in the tail section 31 of the stabilizer cable 50, which then results in a net horizontal force being applied on the suspended load 30, that is directed to the right as shown in the drawing of FIG. 15, i.e. a force acting in the direction of the crane boom 55. This causes the load 30 to move towards the crane boom 55, in a different path than the load 30 would travel if it were being lowered and raised by action of either the lifting winch 52 or the traction winch 464.

It should also be noted that the maximum tension placed on the load section 29 of the stabilizer cable 50 should be limited so that the torque required of the drum winch 470 can be relatively small. Also, the maximum tension placed on the section 29 should not affect the normal lifting of the load 30, which is done by the lifting winch 52. In other words, the max tension produced by the traction winch 464 should not be enough to raise the load 30. A suitably configured torque limiting motor can be used in the traction winch 464, to set the maximum tension in the section 29 of the cable 50 as desired here; such a motor will not be damaged when it is stalled, and can continuously maintain the max tension on the section 29.

While the load 30 is being lowered by action of the lifting winch 52 (rotating counter-clockwise), together with the hook and the headache ball, both of which are attached to the ends of the lift cable 51 and the stabilizer cable 50 at the load 30, the traction winch 464 should be allowed to also rotate counter-clockwise. This enables the closed loop of stabilizer cable 50 to rotate counter-clockwise as the load is being lowered; this may be achieved by allowing the traction winch 464 to free-wheel or rotate under controlled breaking, as the load 30 is being lowered. At the same time, the drum winch 470 can be operated to adjust the path of the load 30, by for example increasing tension in the tail section 31, which then pulls the load towards the boom 55. It should also be noted that in one embodiment, the traction winch 464 in this case should have a maximum torque that is less than that which would allow the empty hook (e.g., unloaded except for the headache ball) to be raised or lowered, consistent with the point made above that the lifting work should be performed by the lifting winch 52 and not the traction winch 464.

Figure 16:
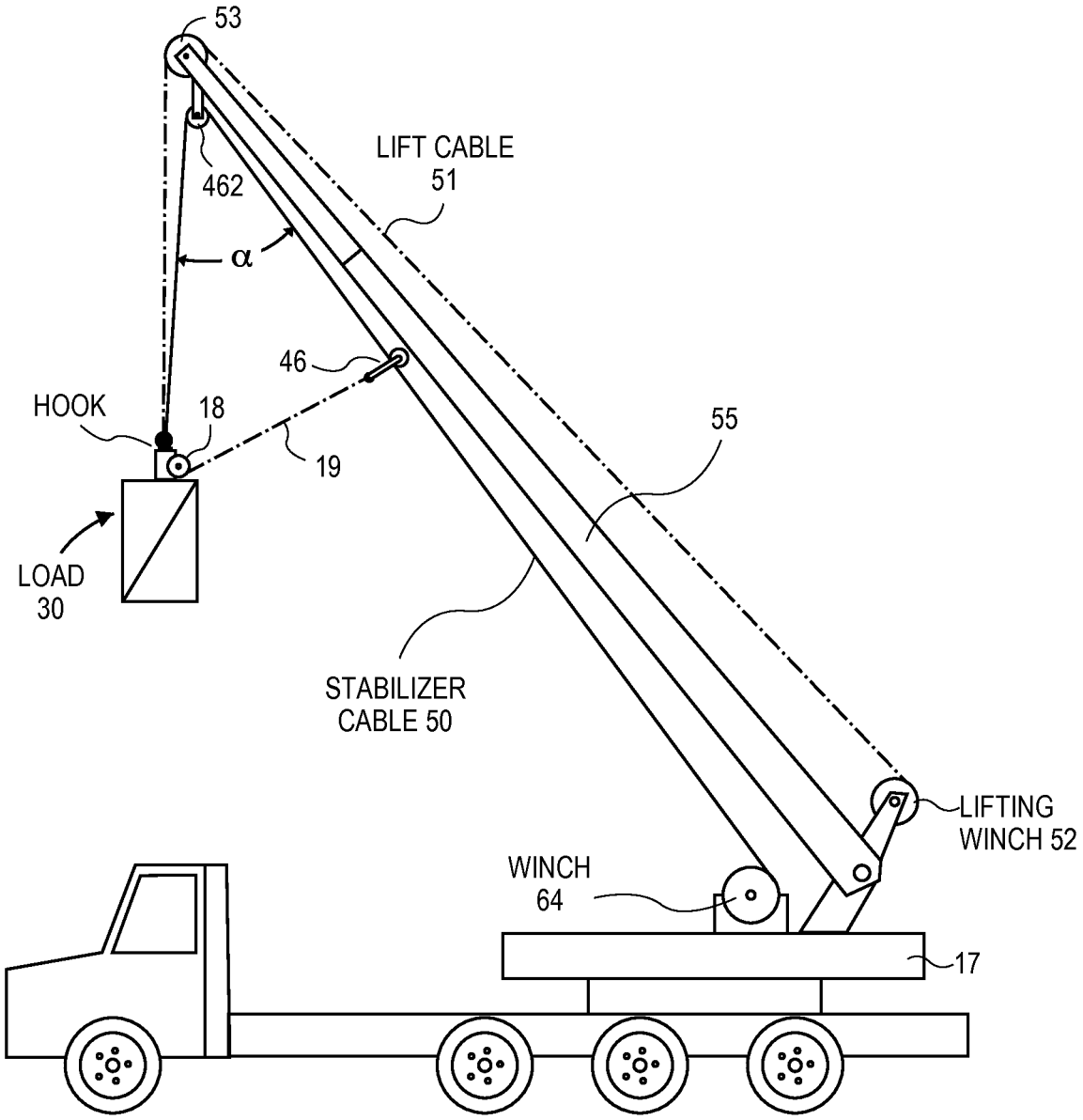
FIG. 16 shows a crane-based lifting system and a stabilizer or horizontal load positioning mechanism that does not require a closed loop of cable.

The lifting and stabilizing systems described so far use a closed loop of cable 468 having a hoist section 29 and a tail section 31. Referring now to FIG. 16, a crane-based lifting system is shown that is similar to FIG. 14 (described above) in that a crane is installed on a vehicle, where the crane can lift the load 30 by suspending the load from a crane boom 55, using conventional techniques for example. However, the horizontal load position control mechanism (or stabilizer mechanism) here is different than the one in FIG. 14. In particular, here, the stabilizer cable 50 is not formed into a closed loop (that rotates clockwise and counterclockwise as the load is raised and lowered, respectively); rather, it is tied at one end to the load 30 and at the other end is held by a winch 64, e.g. wrapped around a drum winch, or looped through a traction winch, which may be secured to the vehicle as shown (and in particular to a turn-table 17). Also, the manner in which a force is generated to pull or bias the load 30 towards the boom 55 (for side-to-side stabilization or sideways positioning of the load 30) is different, as follows.

For the stabilizer/horizontal load position control mechanism in FIG. 16, the cable 50 acts as a guide and remains taut by virtue of the winch 64 operating in a manner similar to the winch 464 of FIG. 14, i.e. as a suitably configured torque motor (to also be described below). A winch 18 (e.g., a drum winch, a powered ascender, or a manually operated crank) is attached to the load 30, e.g. directly to a hook block or otherwise affixed to a rigid extension of the hook block, or directly to a structural member of a cage or container that may constitute the load 30. An adjuster cable or rope 19 may be gripped by the winch 18 (e.g., gripped by the ascender or wound around a drum winch) at one end, and is attached to a traveler pulley 46 at another end as shown, so as to generate a pulling force on the traveler 46 (towards the load 30). By activating the winch 18 in one direction to pull in the cable 19 and thereby increase its tension, the load 30 is pulled to the right, i.e. toward the far side of the tensioned stabilizer cable 50 (which runs along the boom 55). Note that doing so does not substantially increase the vertical stress on the stabilizer cable 50. Activating the winch 18 in the reverse direction will let out the cable 19, thereby allowing the suspended load 30 to move to the left, i.e. away from the tensioned cable 50, e.g. due to just gravity or due to an opposite pulling force (not shown). This causes the load 30 to move towards or away from the crane boom 55, in a different path than the load 30 would travel if it were being lowered and raised by action of the lifting winch 52.

The adjuster cable 19 may be wound around a battery-powered, motorized (e.g., electric or pneumatic motor) drum winch, or it may be gripped by a battery powered rope ascender, so that there is no need for a power cable to run down from the suspended load 30 to the vehicle. Note that in the case of a drum winch, the adjuster cable 19 will inherently wind itself around a drum as it is taken in; not so with the ascender or with a traction winch (which could also be used). As an alternative, the winch 18 may be a manually powered spool or rope ascender that allows an operator riding in a container of the load 30 to, for example, reach up and turn a hand crank, to thereby pull in the adjuster cable 19. The spool should have a locking mechanism such as a cam that grips and prevents the cable 19 from accidentally backing out of the winch 18. Other devices that can pull in the cable 19 and maintain it under tension (therefore biasing the load 30 horizontally or sideways toward the tensioned cable 50, forming a desired angle $\alpha$) are possible. In the preferred approach where the winch 18 is an ascender or drum winch that is battery-powered, a wireless remote-control system may be added that allows control of the activations of the winch 18 by a remotely located human operator. The operator may be located on the ground next to the vehicle, in a nearby tall structure (not shown), in a container being hoisted by the lifting system, or elsewhere.

The drum winch 64, the winch 18, and the lifting winch 52 may be operated independently but at the same time, to position the suspended load 30 appropriately, that is both vertically and horizontally. In this connection, for stabilizing the load 30, a minimum amount of tension may be needed in the stabilizer cable 50 (which runs from the hook, up around the pulley 462 and down to the drum winch 64), sufficient to allow the traveler 46 to use the cable 50 as a guide to provide stabilization for the load 30, and to also actually move the load 30 in a horizontal direction if needed (through activation of the winch 18 as described above).

The maximum tension placed on the stabilizer cable 50 may be limited, so that the normal lifting of the load 30, which is done by the lifting winch 52, is not affected. In other words, the max tension produced by the drum winch 64 when taking in the cable 50 should not be enough to raise the load 30. In one embodiment, the drum winch 64 may have a maximum torque that is less than that which would allow the empty hook (e.g., unloaded, except for a headache ball perhaps—not shown) to be raised or lowered, consistent with the point made above that the lifting work should be performed by the lifting winch 52 and not the drum winch 64. A suitably programmed or configured torque limiting motor can be used for this purpose, in the drum winch 64, to set the maximum tension in the cable 50 as desired; such a motor will not be damaged when it is stalled, and can continuously maintain the max tension.

While the load 30 is being lowered by action of the lifting winch 52 (rotating counter-clockwise), the drum winch 64 should be allowed to also rotate counter-clockwise. This enables the closed loop of stabilizer cable 50 to rotate counter-clockwise as the load is being lowered; this may be achieved by allowing the drum winch 64 to either free-wheel or rotate under controlled breaking, as the load 30 is being lowered. At the same time, the winch 18 can be activated to further adjust the path of the load 30 by, for example, pulling the load 30 towards the crane boom 55.

Figure 17:
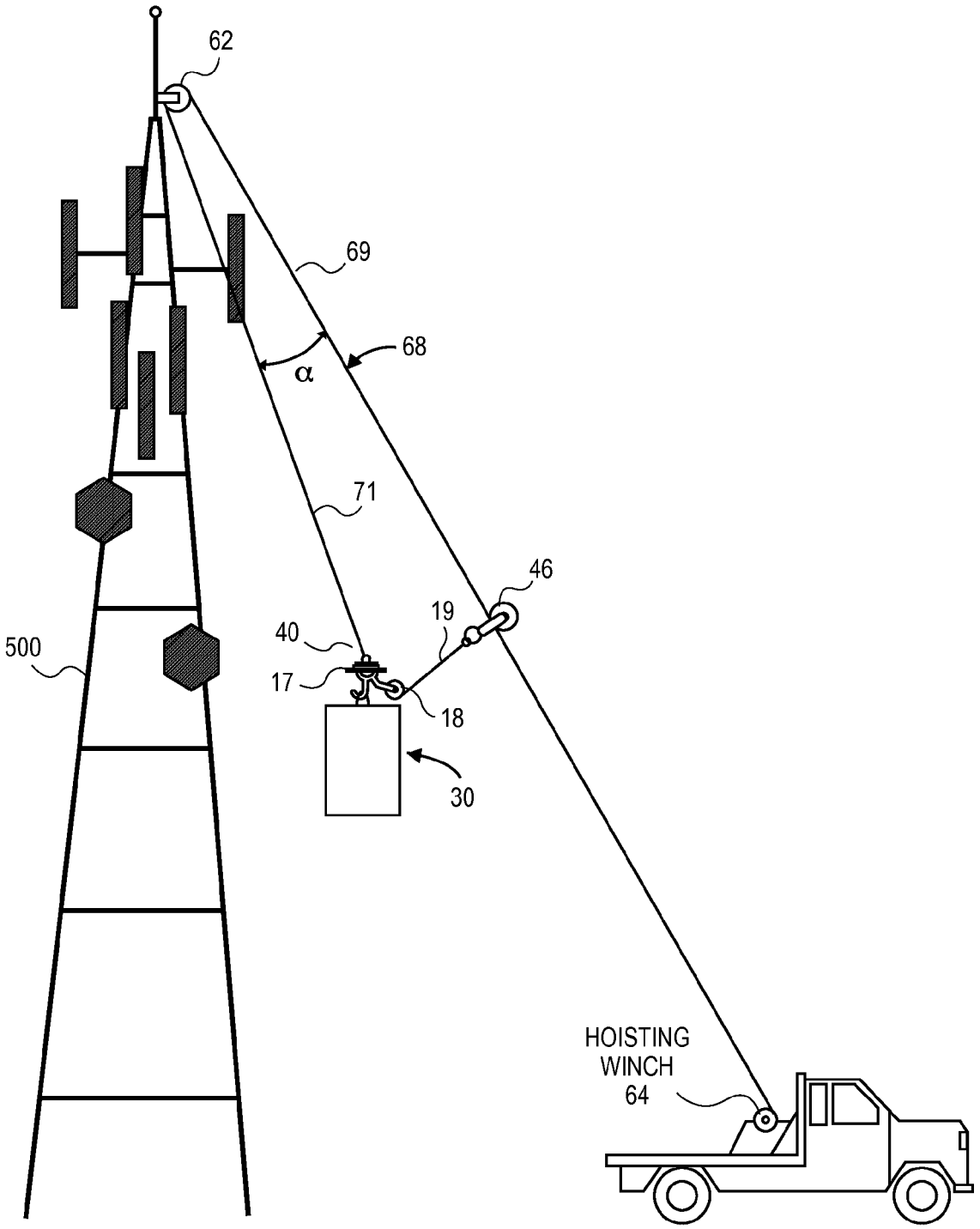
FIG. 17 shows a lifting system that does not require a closed loop of cable but that has a horizontal load position control mechanism.

FIG. 17 shows a conceptual diagram of another lifting system. A tall structure 500 is shown, which may be for example a building, a cellular network communications tower, a wind electricity generation tower (as shown), an offshore oil/gas platform, or an aerial ladder. The lifting system is installed nearby, e.g. at a base of the structure 500, for raising a load 30 to, and lowering the load 30 from, an upper level of the structure 500. The lifting system has an upper pulley 62, a hoisting winch 64 (e.g., a drum winch, or alternatively a traction winch), and a cable 68 (e.g., a single length of wire rope) that has been looped around or installed or reeved around the upper pulley 62 and around the hoisting winch 64. In the example shown, the upper pulley 62 has been secured to the structure 500 above its base area where the hoisting winch 64 is located. The load 30 is attached to and suspended from the cable 68 as shown (once the lifting system has been deployed and the cable 68 is under tension, as shown, due to the weight of the load 30). In this case, the load 30 may be hanging from and may freely pivot relative to a hook block 17, e.g. by a snap hook or other suitable alternative. The hook block 17 is tied to the end 40 of the cable 68. The load 30 may alternatively be rigidly attached to the hook block 17 (see FIG. 18); or the hook block 17 may be an integral part of a structural member of the load 30. The load 30 may be a container or cage in which equipment and/ or persons can be riding. An operator of the system may lift or raise the attached load 30, by activating the hoist winch 64 so that the cable 68 is pulled in or taken in, thereby raising the attached load 30; the operator may lower the attached load 30 by activating the hoist winch 64 in an opposite direction (e.g., under controlled braking), to thereby let out the cable 68 and lower the attached load 30 due to gravity acting upon the attached load 30 to lower the load. Note how the lifting system in FIG. 17 does not need a loop closure mechanism, because the cable 68 does not form a closed loop.

The lifting system of FIG. 17 has a horizontal load position control mechanism that enables its operator to move the suspended load 30 substantially horizontally or sideways, in this example away from and closer to the side or face of the structure 500. To wit, a traveler pulley assembly or traveler pulley 46 is positioned to ride in contact with and along a far side or far portion 69 of the looped cable 68, as the attached load 30 is lowered and raised through operation of the hoisting winch 64. The nearside or near portion 71 of the looped cable 68 can be described as the portion that runs down the left side of the upper pulley 62 (as it is depicted in FIG. 17) and is tied at its end 40 to the load 30. The far side 69 of the cable 68 is under tension, due to the weight of the suspended load 30, and acts like a guide rail to guide or stabilize the load 30. A rope take-in device (or generically, "winch") 18 (e.g., a drum winch, a powered ascender, or a manually operated crank) is attached to the load 30, e.g. directly to the hook block 17, or otherwise affixed to a rigid extension of the hook block 17, or directly to a structural member of a cage or container that may constitute the load 30. An adjuster cable or rope 19 may be gripped by the winch 18 (e.g., gripped by the ascender or wound around a drum winch) at one end, and is attached to the traveler pulley 46 at another end as shown, so as to generate a pulling force on the traveler 46 (towards the load 30). By activating the winch 18 in one direction to pull in the cable 19 and thereby increase its tension, the load 30 is pulled toward the far side of the tensioned cable 68. Note that doing so does not substantially increase the vertical stress on the cable 68 or on the structure 500. Activating the winch 18 in the reverse direction will let out the cable 19, thereby allowing the suspended load 30 to move away from the far side 69 of the tensioned cable 68, e.g. due to just gravity or due to a pulling force (not shown), closer to the structure 500. This back and forth adjustment of the horizontal position of the load 30 can be achieved without the need for the closed loop arrangement and the moveable pulley 466 mechanism that is depicted in FIG. 1 (where a tail line 31 of the cable 468 is reeved around the moveable pulley 466 and one or more deflector pulleys 465, 467 before being tied to the traveler 46 or to the load 30).

Figure 18:
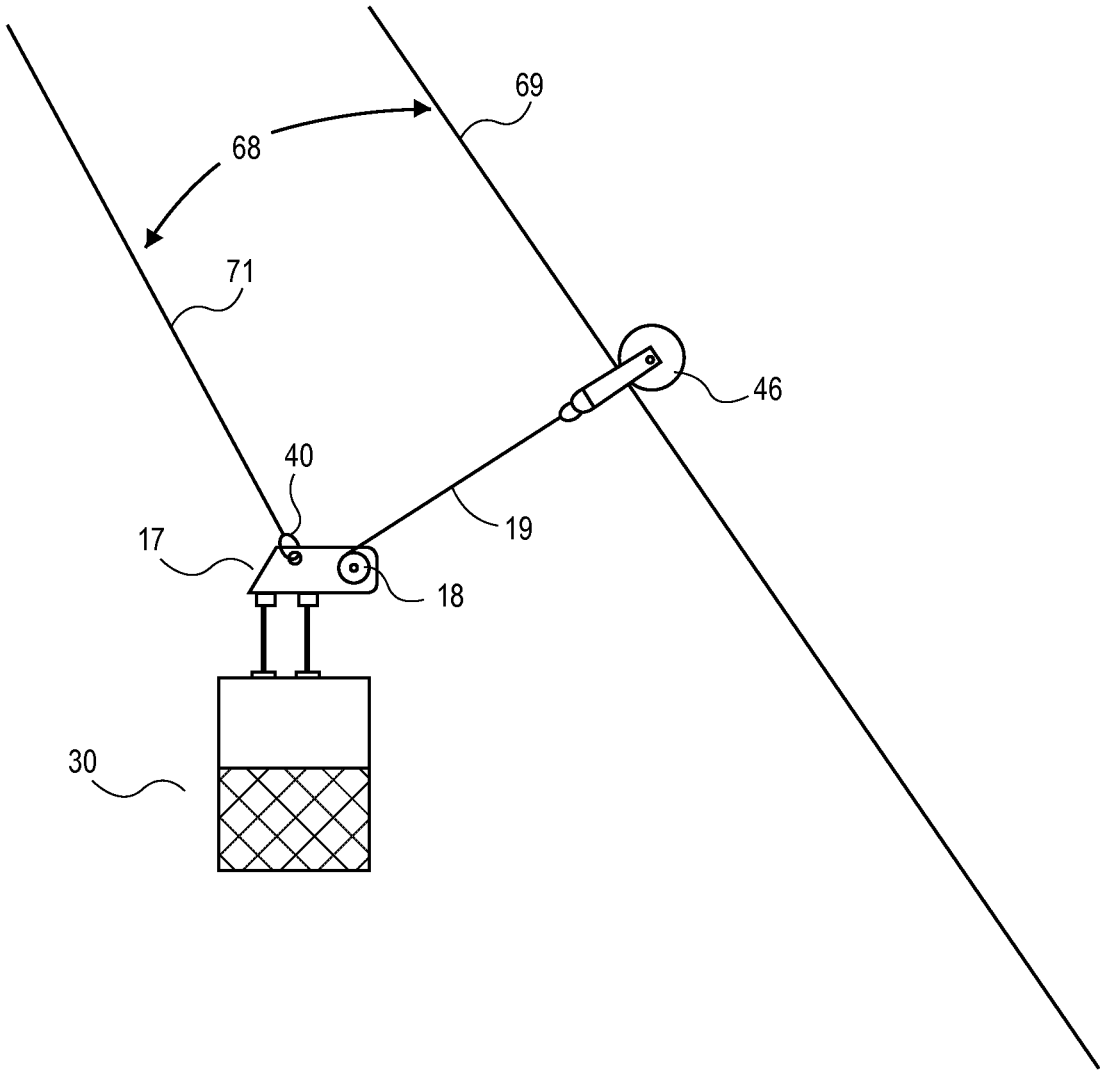
FIG. 18 shows how a container may be rigidly attached to a hook block to form a load of a lifting system.

In the approach depicted in FIG. 17 and FIG. 18, the adjuster cable 19 may be wound around a battery-powered, motorized (e.g., electric or pneumatic motor) drum winch, or is gripped by a battery powered rope ascender, so that there is no need for a power cable to run down from the load 30 to the base area (where the hoisting winch 64 is located). Note that in the case of a drum winch, the adjuster cable 19 will inherently wind itself around a drum as it is taken in; not so with the ascender or with a traction winch (which could also be used). As an alternative, the winch 18 may be a manually powered spool or rope ascender that allows an operator riding in a container of the load 30 to, for example, reach up and turn a hand crank, to thereby pull in the adjuster cable 19. The spool should have a locking mechanism such as a cam that grips and prevents the cable 19 from accidentally backing out of the winch 18. Other devices that can pull in the cable 19 and maintain it under increased tension (therefore moving the load 30 horizontally or sideways toward the far portion 69 of the tensioned cable 68, to achieve a desired angle $\alpha$) are possible, e.g. a traction winch. In the preferred approach where the winch 18 is an ascender or drum winch that is battery-powered, a wireless remote control system may be added that allows control of the activations of the winch 18 by a human operator. The operator may be located at the base area where the hoisting winch 64 may be located, in an upper level in the structure 500, in a container being hoisted by the lifting system, or elsewhere.

Note that both the hoisting winch 64 and the winch 18 may be operated independently but at the same time, to position the suspended load 30 appropriately, that is both vertically (e.g., between the upper pulley 62 and the base area where the hoisting winch 64 is located) and horizontally (closer to and farther away from the structure 500).

Figure 19:
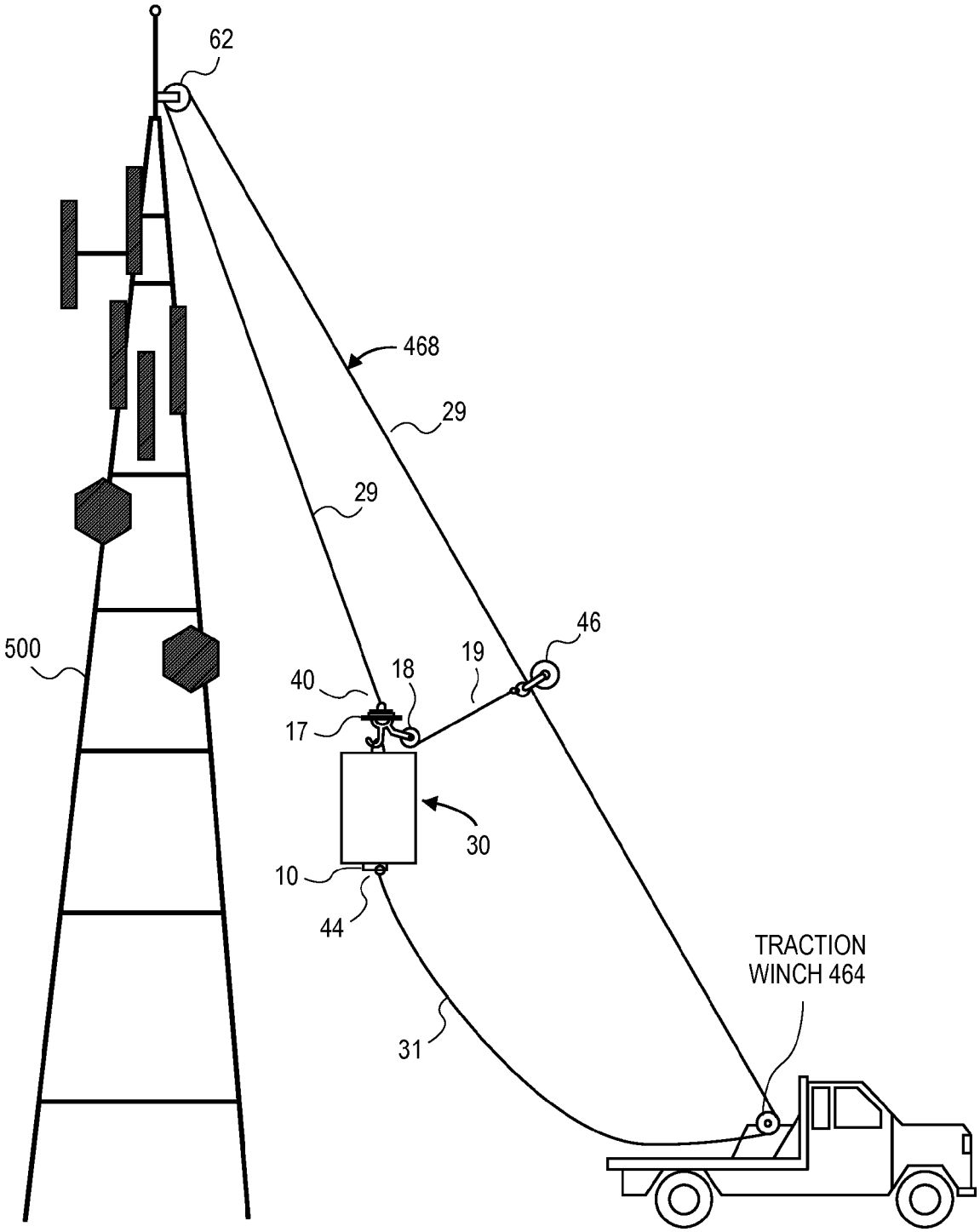
FIG. 19 illustrates a lifting system that uses a closed loop of cable and has a horizontal load position control mechanism similar to that depicted in FIG. 17.

Referring now to FIG. 19, another embodiment of a lifting system is shown that uses the horizontal load position control mechanism of FIG. 17, namely the load-mounted winch 18, the adjuster rope 19 and the traveler pulley 46. In contrast to the system in FIG. 17, however, a looped hoisting cable 468 is closed (to form a closed loop) by virtue of having both a) an end 40 at its load section (also referred to as hoist section) 29, and b) another end 44 at its tail section (also referred to as tail line) 31, secured to the hook block 17 or to a load attachment point 10 (e.g., via snap hooks or other securing mechanisms). The load 30 may include a container body that is attached to the hook block 17 (e.g., as seen in FIG. 17 or FIG. 18). The closed loop of cable 468 has its load or hoist section 29 that starts from the attached load 30, and continues up and around the upper pulley 62 and then down to a traction winch 464 located next to a base of the structure 500. The load 30 is thus attached to the cable 468 at a point that is between its tail portion 31 and its hoist portion 29 which are on the same side of the upper pulley 62, in this example closer to the structure 500. The tail portion 31 may be defined as that portion of the cable 468 which starts from the traction winch 464 down below and continues up to the attached load 30, without passing around the upper pulley 62, and is slack (in contrast with the hoist section 29 which is taut). The tail portion 31 closes the loop, in this case by being attached, at its end 44, to the hook block 17. As an alternative, the loop may be closed by attaching the end 44 of the tail line 31 directly to a member of the cage or container that constitutes the load 30 (e.g., the load attachment point 10). In this embodiment, the traction winch 464 is activated in one direction which rotates the closed loop clockwise under power to thereby raise the load 30, and in the reverse direction to rotate the loop counter clockwise under controlled braking (to thereby lower the load 30).

The embodiment of FIG. 19 may have several advantages. Use of the traction winch 464 avoids the need for a large drum winch (as may be needed for the hoisting winch 64 of FIG. 17), which would be required when the structure 500 is very tall (or when the pulley 62 is positioned very high). Also, with the traction winch 464, the hoisting cable 468 may be pre-installed on the structure 500 when the lifting system vehicle arrives at the job site and can be easily installed into a breech—loadable traction winch; in contrast, an end of the cable 68 needs to be rigged around a drum winch as the hoisting winch 64 in FIG. 17 which is a more complicated task. In addition, the traction winch eliminates the need for winding the cable 68 around the drum winch carefully to form multiple layers. The control system for maintaining constant speed of ascent or descent (of the load 30) is easier with the traction winch 464 (in the embodiment of FIG. 19), as the torque produced by, for example, a constant radius traction sheave or traction pulley also remains essentially constant. Finally, the dead weight of the closed loop of cable 468 is essentially the same on both sides of the pulley 62 as seen in FIG. 19, which may reduce and/or balance out the forces on the traction winch 464 between lifting (hoisting) and lowering (braking); this is not the case when the cable 68 is looped as shown in FIG. 17.

Figure 21:
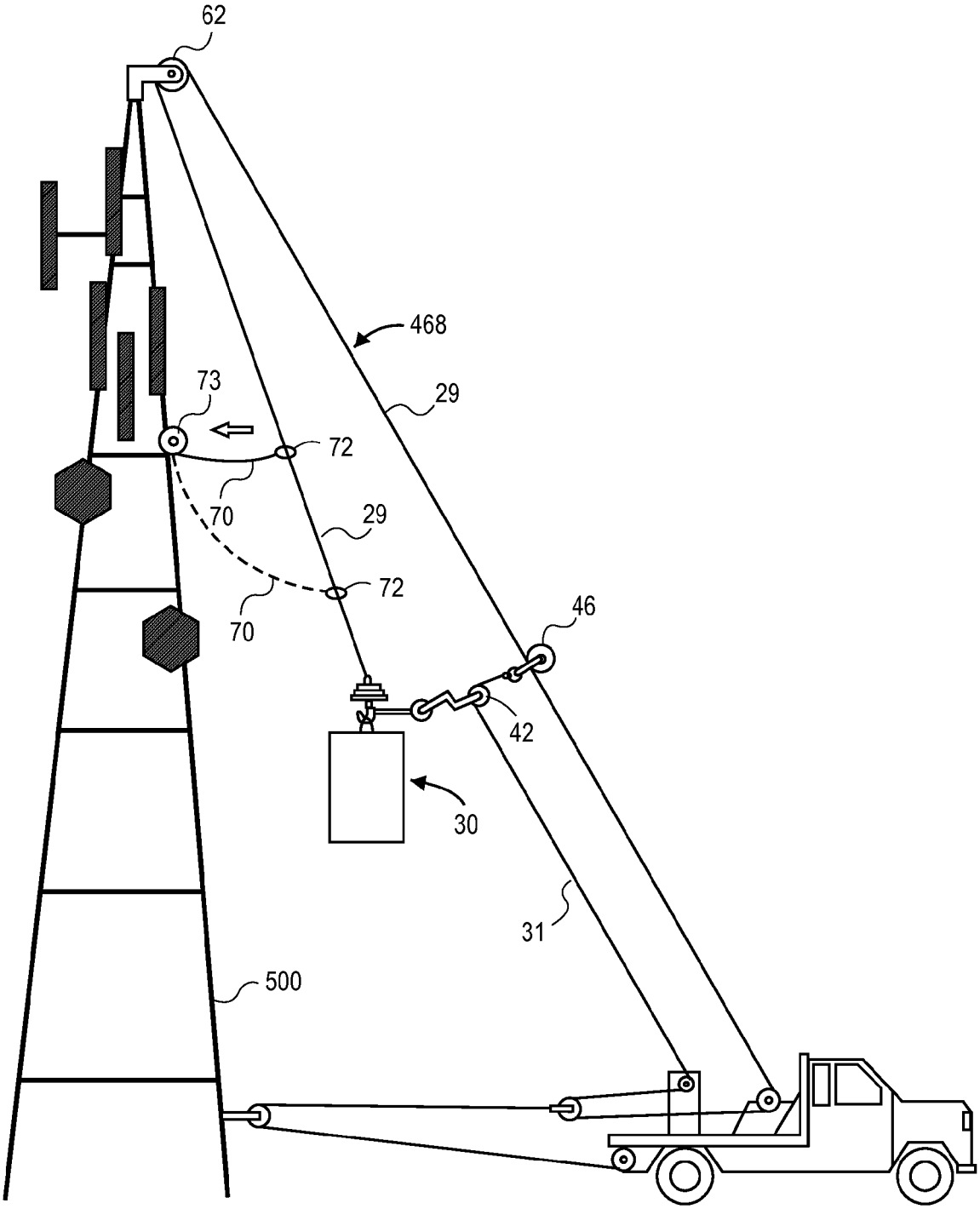
FIG. 21 depicts a lifting system having a pull line that helps urge a suspended load towards the tall structure as needed.

Turning now to FIG. 21, a modification or enhancement to any of the lifting systems described above is shown, where a pull line 70 is added to help an operator of the lifting system urge the suspended load 30 towards the tall structure 500 as needed. One end of the pull line 70 is tied to a ring 72 or traveller or other suitable structure that can easily ride or slide along the tensioned load line 29 of the closed loop (or the tensioned near section 71 of the open loop as in FIG. 17). Another end of the pull line 70 is wrapped around or gripped by a winch 73 or other line take-in device. The latter is attached to the tall structure 500, preferably at a point somewhere above the desired height to which the load 30 is to be lifted. FIG. 21 shows the line 70 in two conditions, one where it has been let out such that it has a lot of slack (shown in dotted lines), and another where it has been taken in such that is very little slack.

Use of the pull-line 70 is particularly useful with a closed loop lifting system (as shown in FIG. 21) when the structure 500 is so tall that the tail line 31, even when it is made completely slack, is so heavy (due in part to its length) that it generates a horizontally directed force that is sufficient to pull the load 30 away from the face of the structure 500. Such a force however can be overcome when an operator of the system activates the winch 73 so as to take in the line 70, causing the ring 72 to pull the tensioned load line 29 towards the face of the structure 500, thereby moving the suspended load 30 closer to the face of the structure 500 (by overcoming the horizontal force created by the weight of the tail section 31). This allows the load 30 be positioned as close to the face of the structure 500 as needed, by continuing to take in more of the pull line 70 until the load 30 can touch the side of the tall structure 500, which allows easier transfer of persons or equipment between the container of the load 30 and an upper level of the structure 500. Examples of the winch 73 include a drum winch, a manually cranking and locking spool, a traction winch, or an ascender.

It should be noted that although the pull line 70 is only shown in FIG. 21 in connection with a particular lifting system that uses a closed loop of cable 468, a traction winch on a wheeled land vehicle, a moveable pulley and auxiliary winch based horizontal load position control mechanism, and the traveller and deflector pulleys as shown, the pull line 70 may also be added in a similar fashion to other lifting systems described above, e.g. those in FIG. 1, FIG. 17 and FIG. 19. More generally, just because a particular feature of the invention is shown in a given figure, this does not mean that the feature is limited to only the species of the invention shown in that figure. In some instances, a given feature, shown and described in connection with one species, can be combinable with another species, such that a whole new figure (and associated textual description) is not needed. This approach is taken in this application so as to reduce the number of unnecessary figures and text in the Specification.

Figures 22A, 22B:
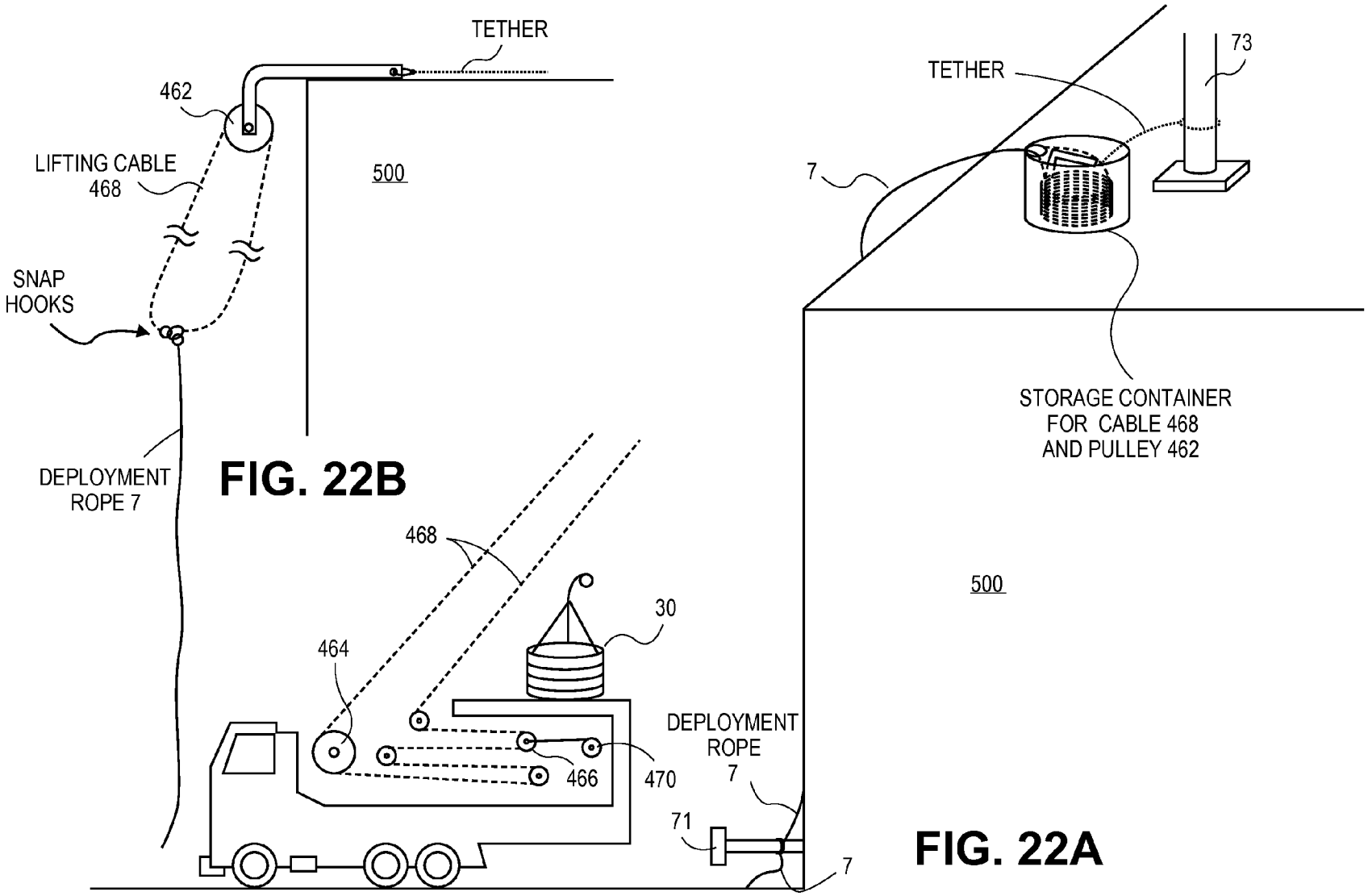
FIGS. 22A and 22B show how a lifting cable and upper pulley of a lifting system can be stored within a container, at an upper level of a tall structure, and to which a deployment rope is attached that reaches down to an area where a vehicle carrying a lifting system winch is positioned.

Turning now to FIG. 22A and FIG. 22B, these figures illustrate how a lifting cable and the upper pulley of a lifting system as described above (for example in connection with FIG. 4) can be deployed from a resting state atop the tall structure 500. A post 23 (generically representing any suitable structural member that is firmed secured to the structure 500) is shown as being anchored or secured to a structural support member of the tall structure 500, e.g. a building. The location of the post 23 may be not just on the roof of the building but also at a pre-determined upper level that is open to the outside as shown, so that a deployment rope 7 can reach down from that location and hang below the upper level down to a base of the structure 500 as shown. At the base, the deployment rope 7 may be tied to a hook 71 or other fixture that is accessible by a human operator who will be attaching a load for the lifting job, at or near the base of the structure 500. The deployment rope 7 can in this manner remain tied alongside the structure 500, until the time comes that a lifting job is needed.

While one end of the deployment rope 7 is tied or otherwise wrapped around the hook 71 at the base, the other end is tied to the lifting cable 468, as shown in FIG. 22B. Snap hooks or other suitable re-useable fastening means may be used here that allow the deployment rope 7 to be easily attached to and removed from the lifting cable 468, by a human operator. In its resting state (awaiting the start of a lifting job) the rope 7 is attached to the lifting cable 468 and may lie within a storage container atop the structure 500 as shown in FIG. 22A. The lifting cable 468 in this state may also be looped around the upper pulley 462. The latter is securely attached to the post 73 by, in this case, a tether, and may also be lying within the storage container.

When a lifting job is to be performed, a human operator arrives at the base of the structure 500 and unties the deployment rope 7 from the hook 71, and pulls down on the rope 7 while moving away from the structure 500 so that the lifting cable 468 is pulled out of the storage container and falls down towards the base. In so doing, because the lifting cable 468 was looped around the upper pulley 462, the falling lifting cable 468 pulls the upper pulley 462 out of the storage container until the upper pulley rests atop the structure 500 and is securely held in place by the tether. Although not shown, a further mechanism may be needed to stabilize the pulley 462 (including its frame) so that the pulley 462 is essentially anchored at a fixed location over an edge or side or face the structure 500, such as shown in FIG. 22B.

The lifting cable 468 having been looped around the pulley 462 is long enough to reach down to the base, and the human operator loops or reeves or otherwise installs the lifting cable 468 into a winch at the base. In one embodiment, the operator couples equipment to the cable 468 so as to form a closed loop, and loops the cable 468 through a pulley system and through a hoist winch or, in this case, the traction winch 464. While FIG. 22A shows the case of a traction winch 464 and a horizontal load position control mechanism that uses an adjustable pulley 466 with an auxiliary or drum winch 470, other types of lifting system pulleys and winches may be used, e.g. the system in FIG. 19 in which a different horizontal load position control mechanism is used, or the one in FIG. 17 in which a cable 468 is attached at its end 40 to the load 30 while its other end is rigged around a hoisting winch 64 such as a drum winch. After the lifting job has been completed and the cable 468 has been removed from the hoist winch (or traction winch) and pulley system at the base, the deployment rope 7 is re-attached to the lifting cable 468. A human operator atop the tall structure 500 may then pull back on the tether and stow away the pulley 462 back into the storage container, and will also pull up the lifting cable 468 until all of it has been stowed away into the storage container. With the deployment cable 7 remaining attached to the cable 468 and hanging down to the base, the end of the deployment rope 7 at the base is then tied once again to the hook 71, so that the system resumes its state shown in FIG. 22A and so is ready for another lifting job.

Figure 23A:
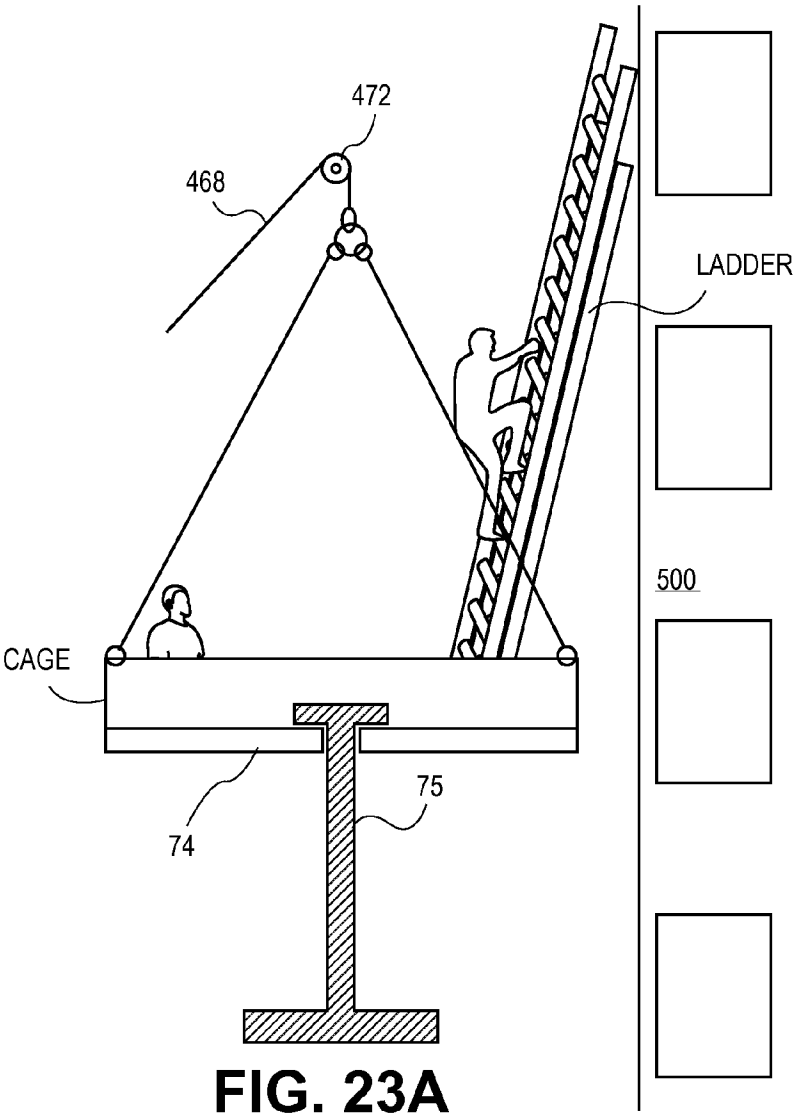
FIG. 23A depicts a suspended container having a ladder therein and a leveling mass, in its extended position.
Figure 23B:
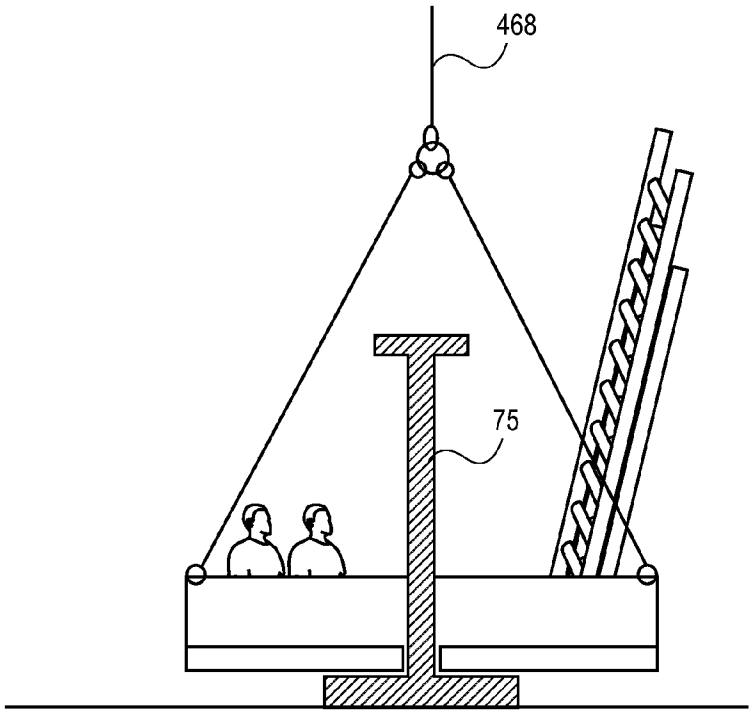
FIG. 23B shows the container of FIG. 23A resting on the ground, with the leveling mass in its retracted position.

Turning now to FIGS. 23A, 23B, these depict a cage 74 (a container) that is to be suspended from a lifting cable (e.g., the cable 468 formed as a closed in accordance with any one of the schemes depicted in FIGS. 1-4, and the cable 68 as used in the scheme of FIG. 17). The cage 74 can be used to raise and lower equipment and personnel, including for example a ladder as shown, to and from an upper level of a tall structure 500 nearby. A leveling mass 75 is moveably supported within the cage 75 such that it can slide between a retracted state in which it is positioned for the most part (or substantially)

above a floor of the cage 74 when the cage is resting on the ground, as in FIG. 23B, and an extended state in which it is positioned substantially below the floor when the cage 74 is suspended, as in FIG. 23A. The leveling mass 75 may have a rod or beam oriented vertically as shown, that has a stop at its upper end (while oriented vertically as shown). As an alternative, the leveling mass may have a more complex structure, e.g. curved, and articulated. The stop comes into contact against the floor of the cage 74 and thereby prevents the rod from sliding completely down and out of the cage 74, when the cage is suspended as seen in FIG. 23A. At a bottom end of the rod, there may be an additional weight or mass as shown, that can touch the ground as the cage 74 is being lowered at the area next to the base of the structure 500, as seen in FIG. 23B. Note however that this additional mass is optional; if the rod itself is sufficiently heavy so that it can maintain the floor of the cage 74 level while the cage is suspended (despite for example the presence of any personnel or equipment, such as the ladder on one side, that imbalances the cage 74), then the additional weight at the bottom end of the rod may not be needed. As the cage 74 continues to be lowered once the rod (or the additional weight, if provided) touches the ground, the cage 74 slides down the rod until the floor comes into contact with the ground (or the additional weight, if provided), as shown in FIG. 23B. In this state, the rod remains stationary and may be held vertically as shown (by a suitable bearing mechanism for example in the floor), extending substantially upward from the floor. As the cage 74 is then raised, the rod retracts out of the cage (downwards) until the stop comes into contact with the floor, assuming the extended state as seen in FIG. 23A. While in this extended state, the leveling mass 75 serves to maintain the floor of the cage 74 level during shifting of weight across the floor (due to for example a human operator raising and then climbing the ladder so as to reach a level of the tall structure 500 that is higher than the cage 74).

Figure 24A:
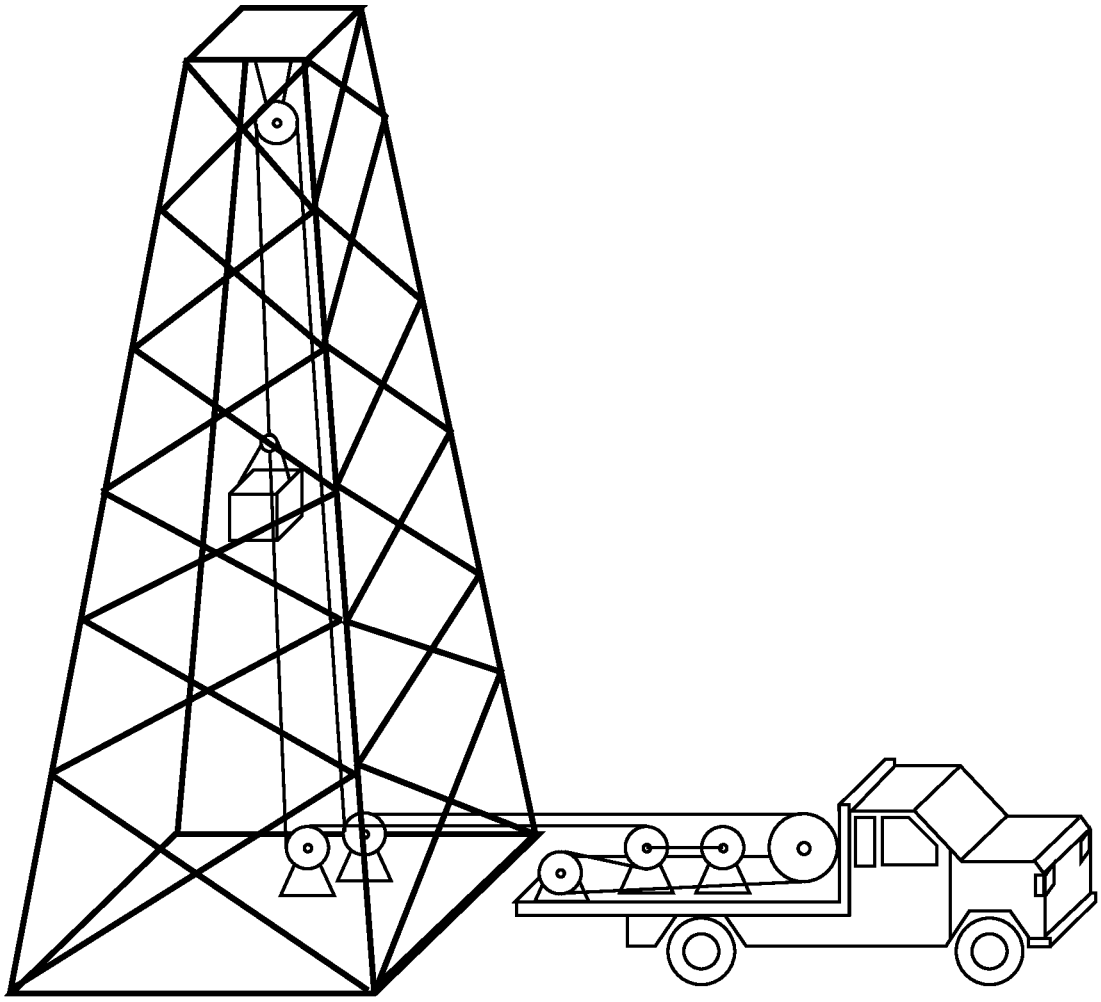
FIG. 24A is a generalized view of a lifting system application in which the load is raised and lowered inside a tall structure.

The lifting systems have been described above in the context of a load that can be raised and lowered while outside of the tall structure 500. Turning now to FIG. 24A, this is a generalized view of a lifting system application in which the load is raised and lowered inside the tall structure 500. As mentioned above, the tall structure 500 may be for example an electric power transmission tower (e.g., a wind power electric generator tower), a wireless communications tower (e.g., a cellular network base station tower), or a tall floating structure (e.g., an offshore oil or gas extraction platform).

Figure 24B:
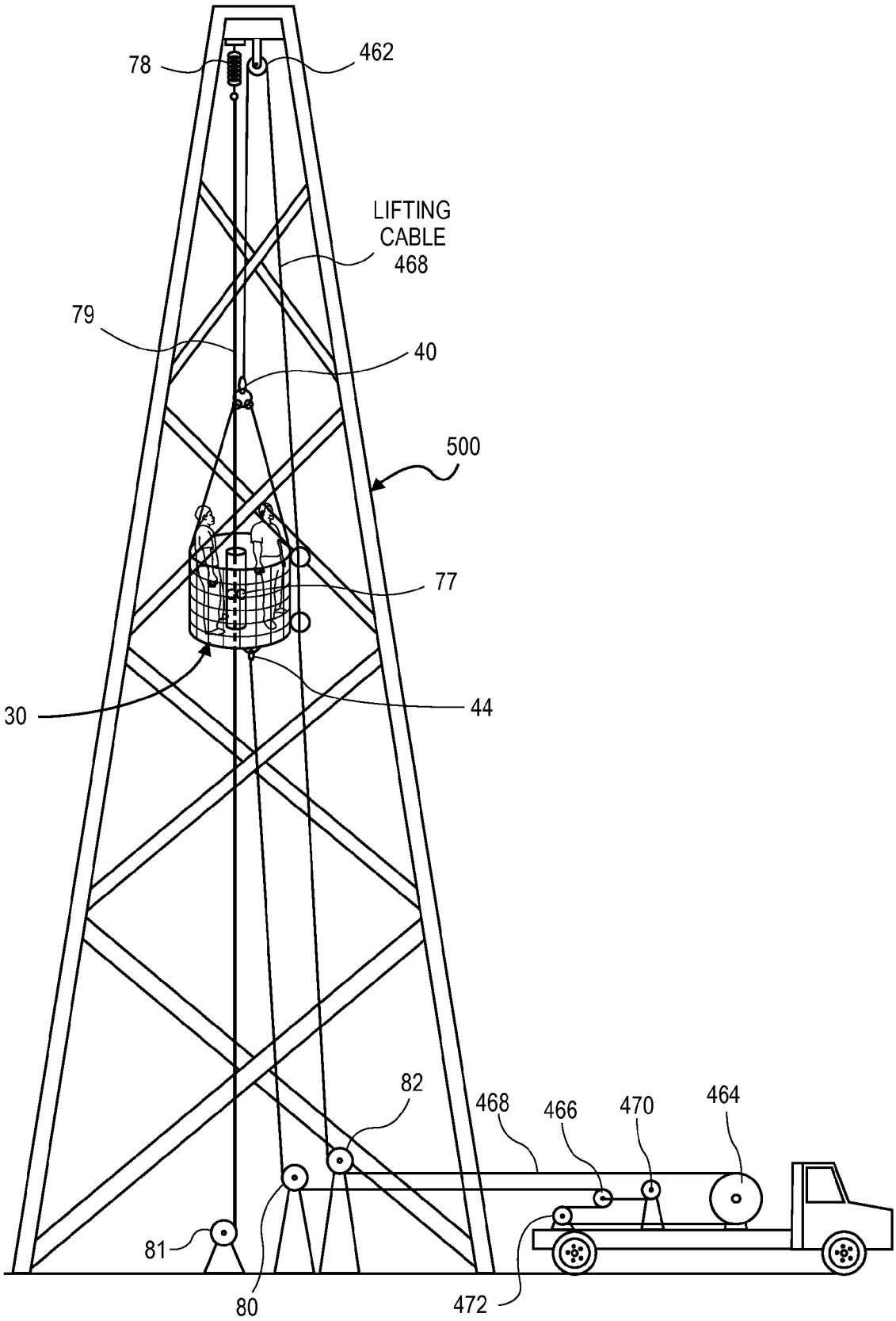
FIG. 24B is a detailed view of the lifting system application of FIG. 24A.

As seen in FIG. 24A, and in detail in FIG. 24B, a vehicle (in this case a wheeled vehicle such as a flat bed truck but alternatively a floating watercraft) having installed on its bed a winch and pulley system is brought to the tall structure 500 and is secured next to its base. A closed loop lifting system is then deployed, using a lifting cable 468 that has been looped around an upper pulley 462; the latter is secured to an upper level of the tall structure 500 and is entirely inward of the outside periphery of the structure 500. The cable 468 is long enough so that both ends can reach down to the area next to the base of the tall structure 500, through an open path inside the structure 500. A pair of deflector pulleys 80, 82 are located inside the structure 500 (e.g., directly attached, either temporarily or permanently, to the ground or to a wall or a structural member of the tall structure 500). In its hoist section, the cable 468 is attached to a load 30 at its end 40, extends up and around the upper pulley 462 and then back down where it is looped around the deflector pulley 82 as shown, before extending outside of the structure 500 and reaching the vehicle. There, the hoist section of the cable 468 is looped through a traction winch 464 before being re-directed by the lower pulley 472. The cable 468 then continues by being looped around the moveable pulley 466 (which may be floating as shown, while being held by tension in the cable 468), and is then redirected by the deflector pulley 80 before running up along the tall structure 500 and attaching to the load 30. Note that this arrangement forms a closed loop out of the cable 468, by in this case tying the end 40 of the hoist section of the cable 468 to the load 30 and by tying an end 44 of the tail section of the cable 468 also to the load. In such an arrangement, there is no need for the loop closure mechanism of FIG. 2 or FIG. 3. Also, the moveable pulley 466 in this case serves to set the tension in the tail section of the closed loop, and does not perform any sideways control of the suspended load 30.

The cable 468 may have been previously looped around the upper pulley 462 and tied to a secure point inside the structure 500, prior to arrival of the vehicle to the base of the structure 500. Alternatively, a deployment rope may have been previously looped around the upper pulley 462 and to which an end of the cable 468 is attached by a human operator down at the base, and then the other side of the deployment rope is pulled down until the cable 468 has been looped around the upper pulley 462 and back down to the base. In yet another embodiment, a mechanism similar to the one described above in connection FIG. 5 can be used to achieve a variable set height for the upper pulley 462.

With the container or basket forming the load 30 attached to the cable 468, the tension adjustment mechanism and in particular its moveable pulley 466 may be operated to place the tail section of the closed loop in tension as shown. Although not shown, the vehicle should be anchored at this point, so that it does not move towards the structure 500 as the cable 468 is being tensioned. For example, the vehicle could be positioned closer to the base of the structure so as to be to rigidly connected to the base, for example to the legs of the tower shown in the figure.

In one embodiment, tensioning of the cable 468 is achieved using the moveable pulley 466 around which the tail section of the cable 468 is looped. The pulley 466 is attached to an adjuster cable 474 whose other end is wound around an auxiliary winch (e.g., a drum winch) 470. Activating the auxiliary winch results in take-in of the adjuster cable 474 to thereby pull the pulley 466 and thereby increase tension in the tail section. Separately, the suspended load 30 can be raised and lowered by activating the traction winch 464 to thereby rotate the closed loop of cable 468 counterclockwise and clockwise, respectively. As a result of the latter, note how the deflector pulleys 80, 82 will always be rotating in opposite directions to each other.

FIG. 24B also shows an optional aspect of the invention, namely a backup safety-holding mechanism that includes an auxiliary cable or rope 79 that runs substantially parallel to and adjacent the lifting cable 468, and is tied at one end to a shock absorbing spring device 78 (e.g., a mechanical coil spring attached near the upper pulley 462) and at another end to a hook or capstan 81 (or other device around which the rope 79 can be securely wound, after the rope 79 has been pulled to set a desired tension in it). The auxiliary rope 79 is reeved through an over-speed and slack rope brake device 77 that is affixed to the basket or container (that forms the load 30), so that in the event of a failure of any portion of the lifting system (e.g., the lifting cable 468, the traction winch 464, and pulleys 80, 82, 462), the brake device 77 will be automatically activated to slow down and prevent the load 30 from dropping to the ground or dropping too rapidly, by gripping the aux rope 79. Any sudden shock imparted to the rope 79, as a result of the brake device 77 being activated, may be alleviated by the shock-absorbing spring device 78. To help prevent the basket or container (of the load 30) from tilting too far during a possible rapid deceleration of it, performed by the activated brake device 77, the brake device 77 and the rope 79 may be positioned at about the center of the load 30 as shown. In that case, and the rope 79 may also be shielded from the occupants of the load 30 as shown.

A further aspect of the embodiment depicted in FIG. 24B is the ability to stabilize the suspended load 30 against sideways motion caused by for example wind. The tension created in the tail and hoist sections of the lifting cable 468 (and perhaps in the auxiliary rope 79) can be used to stabilize the load 30 in a sideways direction. This may be achieved by running the hoist section of the cable 468 through one or more rings that are affixed to for example the outside of the container or basket (the figure shows two rings, as an example). Although not shown in the figure, an alternative that avoids the need for the outside rings is to position the hoist section of the lifting cable 468 so that it passes through a passage inward of the periphery of the load 30 (e.g., the same passage at about the center of the load 30 through which an adjacent or loosely touching rope 79 passes).

The Detailed Description above supports the following additional statements of invention.

An embodiment of the invention is a lifting system comprising an upper pulley, a traction winch, a cable that is looped around the upper pulley and the traction winch, a traveler frame to which a traveler pulley and a deflector pulley are attached, a tail section of the cable being looped around the deflector pulley and then attached to a load, the load being further attached to a hoist section of the cable, wherein the traction winch is to operate in one direction to thereby pull in the cable and raise the attached load, and in another direction to thereby let out the cable and lower the attached load, the lifting system further comprising a horizontal load position control mechanism that is to a) increase tension in the tail section of the cable and thereby move the attached load in a sideways direction and b) decrease tension in the tail portion and thereby move the attached load in another sideways direction. The upper pulley may be attached to a non-portable tall structure such as a building, a tower, or an offshore platform. The traction winch and the horizontal load position control mechanism can be installed on a vehicle, e.g. a truck bed, so that there is no need to attach any constituent pulley or rope of the lifting system to a point off the vehicle (except the upper pulley). The horizontal load position control mechanism may use a moveable pulley around which the cable is looped, and a force is generated or applied that moves the moveable pulley to thereby increase tension, maintain a static tension, and decrease tension in the tail section of the cable, as desired to control the sideways or horizontal positioning of the suspended load. In one embodiment, the moveable pulley is pulled by an adjuster rope that is wound around a powered drum winch; in another embodiment, the moveable pulley is rigidly connected to an actuator that may be powered by a motor (e.g., hydraulic, pneumatic, or electro-mechanical).

In another embodiment, a crane-based lifting system comprises an upper pulley, a traction winch, a cable that is looped around the upper pulley and the traction winch, a loop closure mechanism that forms a closed loop out of the cable wherein a load is attached to the cable; the traction winch is to operate in one direction to thereby pull in the cable (which rotates the cable in one direction which in turn raises the attached load), and in another direction to thereby let out the cable (which rotates the cable in another direction which in turn lowers the attached load); the lifting system further comprises a horizontal load position control mechanism that is to a) increase tension in the tail section of the cable and thereby move the attached load in a sideways direction and b) decrease tension in the tail portion and thereby move the attached load in another sideways direction. The upper pulley is attached to a boom or ladder of a crane, and wherein the traction winch and the horizontal load position control mechanism together with the crane boom or ladder are all installed on a turntable of the crane—see FIG. 11, for example. In one such embodiment, no constituent pulley or rope of the lifting system needs to be attached to a point off the turntable. This means that the entire lifting system including the upper pulley, the traction winch and the horizontal load position control mechanism can rotate together with the turntable. In yet another crane-based version, the traction winch and the horizontal load position control mechanism can be positioned off the turntable such as on a separate vehicle (while the upper pulley remains attached to the crane boom which in turn may or may not be installed on a turntable).

Referring to FIG. 5, an embodiment of the invention is a method for deploying a lifting system comprising: attaching an upper pulley to a deployment rope, wherein the upper pulley has a lifting cable looped around it and the deployment rope is looped around a top pulley that is attached to a tall structure; taking in the deployment rope on one side of the top pulley to thereby raise the upper pulley one another side of the top pulley, wherein the lifting cable remains looped around the upper pulley while the latter is being raised; when the upper pulley has reached a desired height, securing the deployment rope to thereby fix the suspended upper pulley at the desired height.

In one embodiment, the lifting cable is looped around or installed onto a traction winch, such as a breach loadable traction winch. In that case, a closed loop of cable is formed out of the lifting cable, by for example looping a tail section of the cable around a deflector pulley, and attaching the cable to a traveller pulley, which will passively ride along a hoist section of the cable. A load is attached to the lifting cable. The tail section of the closed loop of cable is rendered taut, and the traction winch is operated in one direction to thereby pull in the cable and raise the attached load, and in another direction to thereby let out the cable and lower the attached load. The method may further comprise a stabilization or horizontal load position control process, by a) increasing tension in the tail section of the cable to thereby urge or move the attached load in a sideways direction and b) decrease tension in the tail portion to thereby allow the attached load to move in another sideways direction (e.g., due to gravity acting upon the load).

In another embodiment, the lifting cable is rigged or wrapped around a drum winch, while another end of the cable is attached to the load. In that case, the drum winch is operated in one direction to thereby take in the cable and raise the attached load, and in another direction to thereby let out the cable and lower the attached load (e.g., due to gravity acting upon the load). In this embodiment, a different stabilization or horizontal load position control process may be used as follows: a stabilizer cable or rope is attached at one end to a traveler pulley and at another end is taken in by a stabilizer winch device, where the latter is attached to the load; the traveller pulley is positioned to passively ride along a far section of the lifting cable while the suspended load is being raised or lowered through action of the drum winch; separately or independently from operating the drum winch, an operator riding in a suspended container (as the load) can operate or signal the stabilizer winch to take in the stabilizer cable thereby urging the load towards the far section of the lifting cable (e.g., away from the tall structure). Reversing the stabilizer winch may then let out the stabilizer cable, thereby allowing the load to move sideways closer to the tall structure (e.g., due to gravity acting upon the load).

Figure 20:
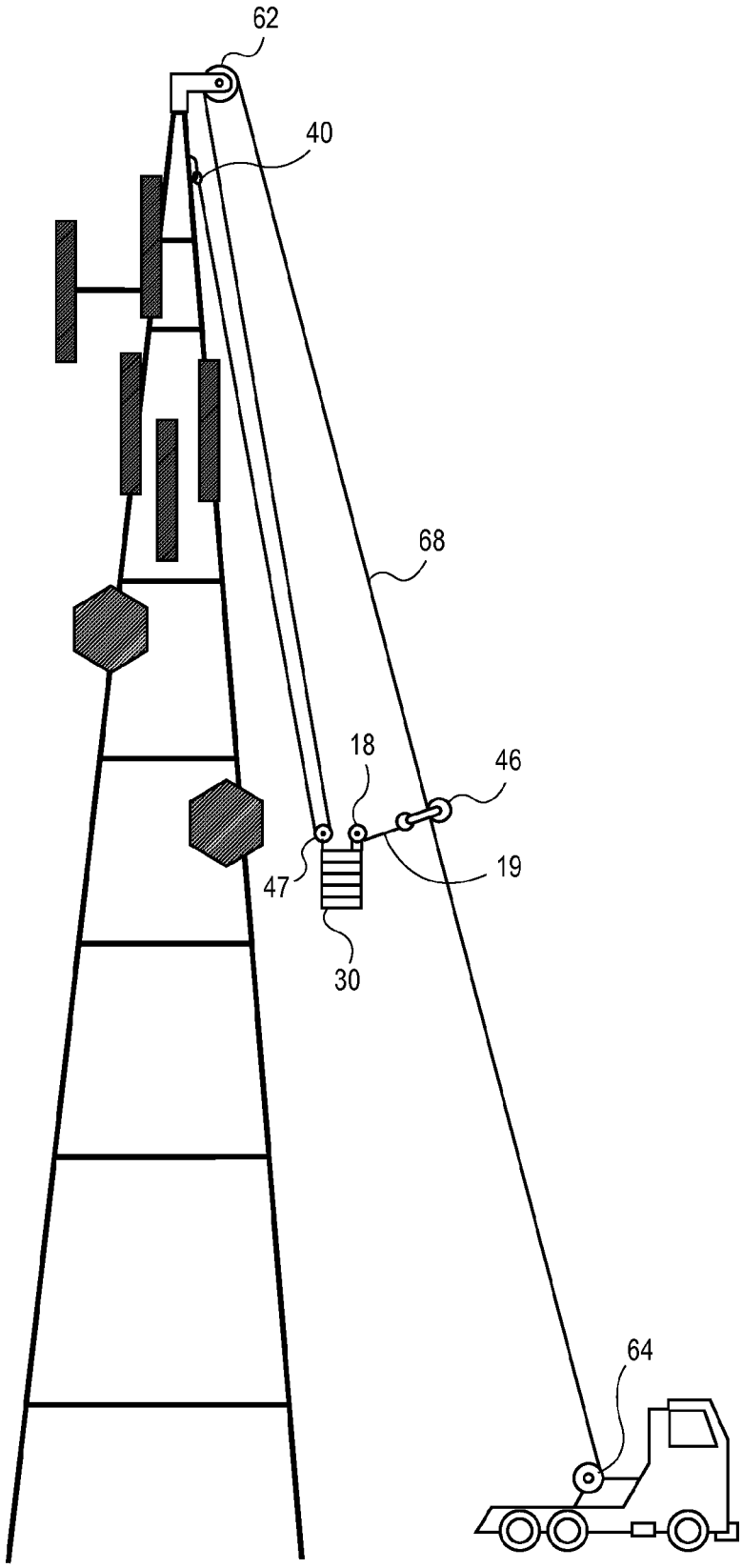
FIG. 20 shows a lifting system in which an end of the lifting cable is tied to a tall structure next to which a load is to be lifted and raised.

While certain embodiments have been described and shown in the accompanying drawings, it is understood that such embodiments are merely illustrative of and not restrictive of the broad invention, and that the invention is not limited to the specific constructions and arrangements shown and described, since various other modifications may occur to those of ordinary skill in the art. For example, the diagrams here are generally not to scale, and are merely being used to illustrate the concept of the system. Also, in practice, the relative size, location, and number of pulleys used may be slightly different than shown. For instance, one or more deflector pulleys (not shown) may be added into the reeve path of the cable 468 or the cable 68, in order to route sections of the loop cables differently, e.g. to clear a particular obstacle. In addition, a double rigging mechanism may be fitted to increase the lifting capacity of the system—see FIG. 20 for example. There, a pulley 47 has been added, secured to the hook block 17 or to the load 30 directly, around which the cable 68 (of the embodiment in FIG. 17) has been looped. In this embodiment, the end 40 of the cable 68 is secured to the structure 500 at some point above an upper level of the structure 500 to which the load 30 is to be raised. Note also that the truck or other land vehicle depicted in FIG. 20 on which the hoisting winch 64 is installed may alternatively be a floating vehicle such as a boat, especially where the structure 500 is an offshore oil/gas platform (rather than the example shown, which is a communications tower that is built on land). As another example, while the pulley 472 is shown in FIG. 4 as being secured or anchored to the tall structure 500, at the base where the vehicle is located, an alternative is to secure the pulley 472 directly to the ground near the vehicle, or to another relatively immovable surface, i.e. immovable relative to the load 30 as it is being raised and lowered. For instance, the pulley 472 can be fixed to the vehicle itself (e.g., similar to what is shown in FIG. 9 or in FIG. 12). The description is thus to be regarded as illustrative instead of limiting.

Accordingly, there may be an aspect of the system in one figure that can be combined or incorporated into the system of another figure in accordance with various embodiments of the invention described here.

What is claimed is:

1. A lifting system comprising:

a pulley attached to a structure;

a lifting cable looped around the pulley;

a load attached to a hook block that is attached to the looped lifting cable, the load being a container configured to be suspended from the looped lifting cable;

a hoist winch on a mobile vehicle located in an area next to a base of the structure, the hoist winch being operable upon the looped lifting cable to raise the attached load and to lower the attached load, the container configured to transfer persons and equipment between the area next to the base of the structure and a level of the structure that is below the pulley and above the vehicle;

and a device attached directly to the load or directly to the hook block, the device is attached to the looped lifting cable via an adjuster cable and a traveler pulley, the traveler pulley being attached to the adjuster cable which is separate from the lifting cable, the traveler pulley configured to automatically ride along substantially an entire extent of a length of the lifting cable defined between the pulley and the hoist winch, as a direct result of the load being raised by the hoist winch only or lowered by the hoist winch only, the load positioned between the structure and the traveler pulley, wherein the device is configured to a) pull in the adjuster cable to thereby pull the traveler pulley and the load sideways towards each other, and b) let out the adjuster cable to allow the load to move sideways away from the traveler pulley.

2. The system of claim 1 wherein the device is one of the group consisting of a powered winch, a powered rope ascender, a hand cranked spool, and a capstan winch.

3. The system of claim 1 wherein the device moves up and down automatically with the attached load, as the load is raised and lowered through operation of the hoist winch.

4. The system of claim 1 wherein the device is directly attached to the hook block.

5. The system of claim 1 wherein when the device pulls in the adjuster cable, an angle formed by the lifting cable looped around the pulley decreases, and when the device lets out the adjuster cable the angle increases.

6. The system of claim 1 wherein the hoist winch is a traction winch through which the lifting cable passes before being attached to the load.

7. A method for deploying the lifting system of claim 1, the method comprising:

providing the lifting system of claim 1;

attaching the lifting cable to the hook block so that the lifting cable is looped around the pulley that is attached to the structure, wherein the lifting cable is installed onto the hoist winch;

installing the traveler pulley onto the lifting cable so that the traveler pulley can ride along the lifting cable;

controlling the hoist winch to operate upon the lifting cable and raise the load that is attached to the hook block; and controlling the device so that the device:

a) pulls in the adjuster cable to thereby pull the traveler pulley and the load sideways towards each other, or b) lets out the adjuster cable to allow the load to move sideways away from the traveler pulley.

8. The method of claim 7 further comprising controlling the hoist winch so as to operate upon the lifting cable and lower the attached load, wherein the traveler pulley automatically rides along the lifting cable while the attached load is raised and lowered.

* * * * *